US010646094B2

(12) United States Patent
Asano et al.

(10) Patent No.: US 10,646,094 B2
(45) Date of Patent: May 12, 2020

(54) WIPE SET AND WIPING METHOD USING THE SAME

(75) Inventors: Mika Asano, Nagoya (JP); Takeshi Oguro, Osaka (JP); Tomonori Imamura, Osaka (JP); Masaru Fujimura, Osaka (JP)

(73) Assignees: MS DREAM CO., LTD., Nagoya-Shi (JP); NIPRO CORPORATION, Osaka-Shi (JP)

( * ) Notice: Subject to any disclaimer, the term of this patent is extended or adjusted under 35 U.S.C. 154(b) by 53 days.

(21) Appl. No.: 14/110,673

(22) PCT Filed: Apr. 9, 2012

(86) PCT No.: PCT/JP2012/059638

§ 371 (c)(1),
(2), (4) Date: Oct. 9, 2013

(87) PCT Pub. No.: WO2012/141119

PCT Pub. Date: Oct. 18, 2012

(65) Prior Publication Data

US 2014/0034081 A1 Feb. 6, 2014

(30) Foreign Application Priority Data

Apr. 11, 2011 (JP) ..... 2011-087552

(51) Int. Cl.

| | |
|---|---|
| ***A47L 13/17*** | (2006.01) |
| ***A47L 13/256*** | (2006.01) |
| ***A47L 13/258*** | (2006.01) |
| ***A47L 13/16*** | (2006.01) |
| ***B08B 1/00*** | (2006.01) |

(52) U.S. Cl.

CPC ..... *A47L 13/17* (2013.01); *A47L 13/16* (2013.01); *A47L 13/256* (2013.01); *A47L 13/258* (2013.01); *B08B 1/006* (2013.01)

(58) Field of Classification Search

None

See application file for complete search history.

(56) References Cited

U.S. PATENT DOCUMENTS 5,811,113 A * 9/1998 Dorr et al. ..... 424/404
5,814,159 A * 9/1998 Paley et al. ..... 134/6
(Continued)

FOREIGN PATENT DOCUMENTS

JP 11-501843 A 2/1999
JP 2012-91114 A 5/2012
(Continued)

*Primary Examiner* — Nicole Blan

(74) *Attorney, Agent, or Firm* — Birch, Stewart, Kolasch & Birch, LLP

(57) ABSTRACT

A novel wipe set and a novel wiping method in which the wipe set is used are provided. With the wipe set comprising a first wipe impregnated with 50 to 200 mg of a sodium hypochlorite aqueous solution per gram of the wipe, a second wipe impregnated with 30 to 110 mg of a sodium thiosulfate aqueous solution per gram of the wipe, and a third wipe impregnated with 4 to 110 mg of a sodium hydroxide aqueous solution per gram of the wipe as well as by the wiping method in which the wipe set of the present invention is used, an anticancer agent spilled on a working table, for example, can be removed effectively.

15 Claims, 3 Drawing Sheets

(56) References Cited

U.S. PATENT DOCUMENTS

| | | | | |
|---|---|---|---|---|
| 7,070,737 | B2 * | 7/2006 | Bains et al. | 422/37 |
| 2002/0192731 | A1 * | 12/2002 | H. Shih | 435/7.92 |
| 2004/0187892 | A1 * | 9/2004 | Maguire, Jr. | A46B 3/18 134/8 |
| 2005/0047961 | A1 | 3/2005 | Bains et al. | |
| 2008/0167211 | A1 * | 7/2008 | Pivonka et al. | 510/199 |
| 2009/0321283 | A1 * | 12/2009 | Tourigny | B08B 1/00 206/205 |
| 2011/0132792 | A1 * | 6/2011 | Villalobos | A61K 8/0208 206/524.1 |

FOREIGN PATENT DOCUMENTS

| | | | |
|---|---|---|---|
| WO | WO 96/28262 | A1 | 9/1996 |
| WO | WO 03/031558 | A1 | 4/2003 |

* cited by examiner

WIPE SET AND WIPING METHOD USING THE SAME

TECHNICAL FIELD

The present invention relates to a novel wipe set particularly suitably used for wiping away an anticancer agent or a noxious medical agent having high bioactivity spilled on a working table, for example, and a wiping method in which the wipe set is used.

BACKGROUND ART

In order to remedy various types of cancers, many anticancer agents are known so far. They include an anticancer agent known to have carcinogenicity or suspected to have carcinogenicity. Therefore, an operator who handles an anticancer agent needs to pay careful attention to the danger. Special means for effectively wiping away an anticancer agent if accidentally spilled or leaked on a working table during preparation and transport of the anticancer agent, for example, is required.

For example, the specification of U.S. Pat. No. 5,811,113 (PTD 1) discloses a kit including a first fibrous wipe impregnated with a solution containing 4 to 40 weight % of calcium hypochlorite or sodium hypochlorite and a second fibrous wipe impregnated with a solution containing 4 to 40 weight % of sodium thio sulfate. PTD 1 describes that, by using such a kit in which such wipes impregnated with medical agents (medical-agent-impregnated wipes) are combined and performing an operation of wiping with the first wipe and then wiping with the second wipe, blood infected with HIV can be inactivated and wiped away, and also describes that an anticancer agent can also be inactivated, further decolorized, and wiped away.

CITATION LIST

Patent Document

PTD 1: The specification of U.S. Pat. No. 5,811,113

SUMMARY OF INVENTION

Technical Problem

However, the kit disclosed in PTD 1 is insufficient in the rate of anticancer agents that can be removed by wiping depending on the type, amount and area of an anticancer agent spilled or leaked on a working table. Developments of means and methods that can remove an anticancer agent more effectively have been desired.

One of the causes of insufficient rate of anticancer agents that can be removed by wiping can be considered because the correlation between removal efficacy of a medical-agent-impregnated wipe, namely, chemical degradation capability of an impregnated medical agent, and physical removal of wiping with a wipe was not clear.

The chemical degradation capability is a chemical reaction between a medical agent impregnated into a wipe and an anticancer agent, and is an effect of denaturing and inactivating the anticancer agent. In this reaction, the time for inactivation depends on the type and concentration of a target anticancer agent. As will be proved in experimental examples which will be described later, some anticancer agents are inactivated instantaneously, while other anticancer agents, such as cyclophosphamide, cannot be expected to be degraded in a short time. The physical removal refers to an action of moving and removing an anticancer agent from a contaminated surface to a medical-agent-impregnated wipe in the process of floating the anticancer agent as a contaminant by a wiping operation with the wipe and causing the wipe to adsorb and absorb the agent for disposal.

On the other hand, in situations where an anticancer agent is handled, such as preparation, transport, administration, and disposal of the anticancer agent, which are conducted routinely in the medical field, quick and simple decontamination and cleaning is required. Hence, a wipe that can exhibit the functions of chemical degradation and physical removal to the utmost has been required.

The present invention was made in view of the above-described problems, and has an object to provide a novel wipe set that can remove an anticancer agent spilled on a working table, for example, effectively in chemical and physical senses in a short time, as well as a novel wiping method using the wipe set.

Solution to Problem

A wipe set according to the present invention is characterized by including a first wipe impregnated with 50 to 200 mg of a sodium hypochlorite aqueous solution per gram of the wipe, a second wipe impregnated with 30 to 110 mg of a sodium thiosulfate aqueous solution per gram of the wipe, and a third wipe impregnated with 4 to 110 mg of a sodium hydroxide aqueous solution per gram of the wipe.

Preferably, in the wipe set according to the present invention, the first wipe further contains 7 to 100 mg of sodium hydroxide per gram of the wipe.

Preferably, in the wipe set according to the present invention, a wipe substrate is a nonwoven fabric made of 100% polypropylene.

Preferably, in the wipe set according to the present invention, the first wipe is packed in a packing material configured such that the wipe substrate and the sodium hypochlorite aqueous solution are stored separately, and at the time of use, the substrate and the sodium hypochlorite aqueous solution are mixed to impregnate the substrate with the sodium hypochlorite aqueous solution, the second wipe is packed in a packing material configured such that the wipe substrate and the sodium thiosulfate aqueous solution are stored separately, and at the time of use, the substrate and the sodium thiosulfate aqueous solution are mixed to impregnate the substrate with the sodium thiosulfate aqueous solution, and the third wipe is packed in a packing material configured such that the wipe substrate and the sodium hydroxide aqueous solution are stored separately, and at the time of use, the substrate and the sodium hydroxide aqueous solution are mixed to impregnate the substrate with the sodium hydroxide aqueous solution.

Preferably, the packing material according to the present invention includes two storage portions each being capable of storing a filling, and a barrier sealed part which is peelable by pressing one of the storage portions is formed between the two storage portions.

The present invention also provides a wiping method in which the above-described wipe according to the present invention is used, including the steps of wiping with the first wipe, wiping, with the second wipe, a trace of wiping with the first wipe, and wiping, with the third wipe, a trace of wiping with the second wipe (hereinafter referred to as a "first method").

The present invention also provides a wiping method in which the above-described wipe according to the present invention is used, including the steps of wiping with the third wipe, wiping, with the first wipe, a trace of wiping with the third wipe, and wiping, with the second wipe, a trace of wiping with the first wipe (hereinafter referred to as a "second method").

The present invention also provides a wiping method in which the above-described wipe according to the present invention is used, including the steps of wiping with the first wipe, wiping, with the third wipe, a trace of wiping with the first wipe, and wiping, with the second wipe, a trace of wiping with the third wipe (hereinafter referred to as a "third method").

Preferably, in any of the above-described first to third methods, an interval of at least 60 seconds is set between the respective steps.

Preferably, in any of the above-described first to third methods, an object to be wiped away is an anticancer agent.

Advantageous Effects of Invention

As will be proved in experimental examples which will be described later, the present invention ensures removal of an object to be wiped away even in a region of area approximately double that of conventional cases. A particularly suitable object to be wiped away in the present invention is an anticancer agent spilled or leaked on a working table, for example. A contribution to avoidance of health damage to an operator that would be caused by an anticancer agent can thereby be made.

DESCRIPTION OF EMBODIMENTS

<Wipe Set>

Figure 1:
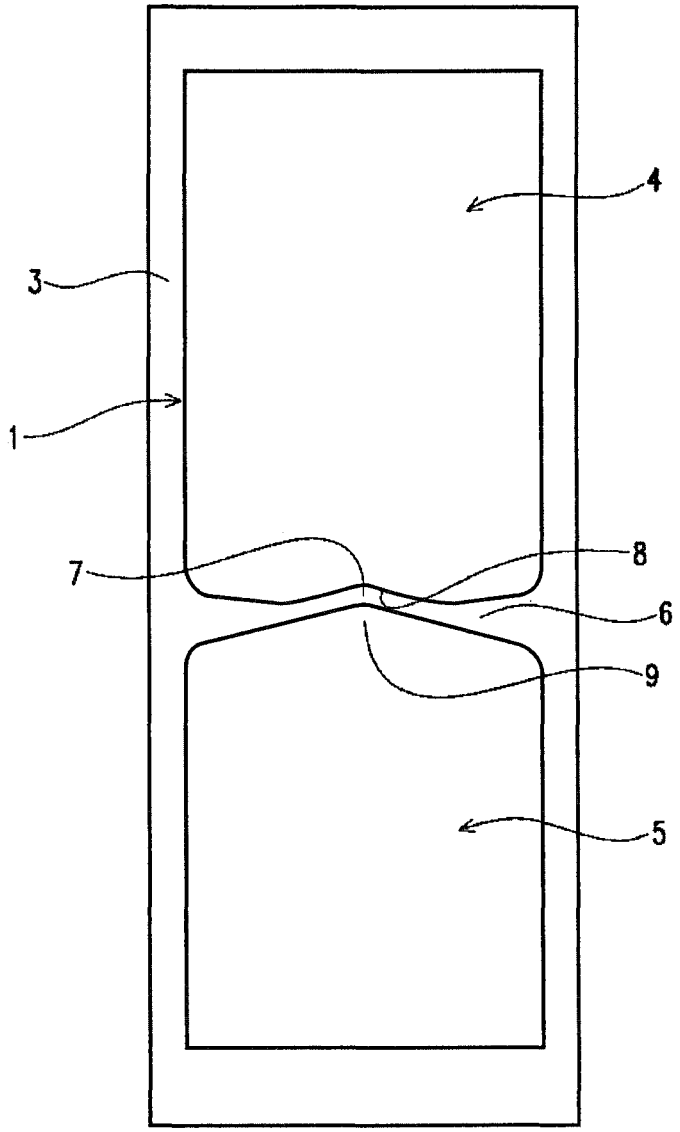
FIG. 1 is a plan view schematically showing a packing material as a preferable example used for a wipe set of the present invention.

A wipe set of the present invention is characterized by basically including a first wipe impregnated with a sodium hypochlorite aqueous solution, a second wipe impregnated with a sodium thiosulfate aqueous solution, and a third wipe impregnated with a sodium hydroxide aqueous solution. Each wipe will be described below.

(1) First Wipe

The first wipe according to the present invention is impregnated with a sodium hypochlorite aqueous solution. In the case where an object to be wiped away is a medical agent such as an anticancer agent, wiping with this first wipe exerts an effect of denaturing the medical agent to reduce its medicinal effect or eliminate its medicinal effect.

The first wipe contains 50 to 200 mg (preferably 65 to 170 mg) of sodium hypochlorite per gram of the wipe. This is because, if the first wipe contains less than 50 mg of sodium hypochlorite per gram of the wipe, the effect of inactivating an anticancer agent is likely to become weaker, and if sodium hypochlorite exceeds 200 mg, which is a high concentration, danger during a wiping operation and handling for disposal increases, which may deteriorate a wipe substrate and a packing material. It is noted that the content of sodium hypochlorite contained in the first wipe per gram of the wipe can be checked by, for example, measurement of an effective chlorine concentration, or simply by the colorimetric analysis with an iodine potassium reagent or the like.

Preferably, the first wipe further contains 7 to 100 mg, preferably 8.5 to 34 mg of sodium hydroxide per gram of the wipe. This is because, if the first wipe contains less than 7 mg of sodium hydroxide per gram of the wipe, sodium hypochlorite as a main constituent is likely to be more acidic, and a chlorine gas may be produced to promote degradation and significantly reduce the effective chlorine concentration. In addition, the packing material having barrier capability is likely to be deteriorated. Addition of sodium hydroxide exceeding 100 mg does not cause a great different from the case of not adding sodium hydroxide in terms of maintenance of the effective chlorine concentration, though deterioration of the packing material can be suppressed.

As the substrate of the first wipe, a conventionally well-known appropriate wipe substrate can be used without particular restriction. Examples thereof include an olefin-based nonwoven fabric made of polypropylene, polyethylene or the like, a nonwoven fabric made of a mixture thereof with pulp, and the like. In particular, a 100% olefin-based nonwoven fabric is excellent in chemical resistance stability, and is effective in stabilizing the concentration of sodium hypochlorite. A hydrophilized material or a hydro-unit material is advantageously excellent in absorbability by itself, which can be manufactured easily as it is. Particularly suitably, it is preferable to use a nonwoven fabric made of 100% polypropylene that produces less reaction with a medical agent impregnated into the wipe, maintains a required concentration of the medical agent until just before use since manufacture, and does not deteriorate in wipe physical properties. Suitable specific examples of the wipe substrate include commercial products such as 33300 SERIES WIPES/100% melt-blown polypropylene 33309 wipe (provided by MAXCLEAN Corporation).

Although the size (area) of the first wipe is not particularly restricted, it is preferable that the size falls within the range of 315 to 930 $cm^2$, more preferably 525 to 930 $cm^2$, from the viewpoint of easy wiping of an area of about 3500 $cm^2$, which is the smallest space used for preparation of an anticancer agent in the medical field, and safe and easy disposal. Although the thickness of the first wipe is not particularly restricted, it is preferable that the thickness falls within the range of 0.2 to 0.5 mm, more preferably 0.2 to 0.3 mm from the viewpoint of usability, because a wiped-away anticancer agent will be likely to penetrate through an excessively thin wipe to the back side and cause recontamination of a glove or the like.

When manufacturing the first wipe according to the present invention, the method for impregnating the substrate with a sodium hypochlorite aqueous solution is not particularly restricted. The substrate can be manufactured suitably by dipping the substrate into a sodium hypochlorite aqueous solution of a desired concentration and amount (which is larger than the amount to be impregnated).

(2) Second Wipe

The second wipe according to the present invention is impregnated with a sodium thiosulfate aqueous solution. Wiping with this second wipe exerts an effect of neutralizing sodium hypochlorite remaining after previous wiping with the first wipe, as will be described later. It is intended to thereby protect a metal surface of a working table, such as a stainless steel surface, from oxidation degradation due to a strong oxidative effect caused by sodium hypochlorite remaining on the cleaning surface after the wiping operation. It is also effective in degrading an anticancer agent such as cisplatin.

The second wipe contains 30 to 110 mg (preferably 35 to 92 mg) of sodium thiosulfate per gram of the wipe. This is because, if the second wipe contains less than 30 mg of sodium thiosulfate per gram of the wipe, the capability to neutralize the residue after wiping with the first wipe will be insufficient, and a floor substrate of stainless steel or the like is likely to suffer from oxidation degradation. If sodium thiosulfate exceeds 110 mg, excessive sodium thiosulfate may be left on the wiped surface. It is noted that the content of sodium thiosulfate contained in the second wipe per gram of the wipe can be checked by, for example, a titration method by way of an iodine reaction of starch, or the like.

The substrate, size (area), thickness, surplus absorption capacity, and the like of the second wipe are similar to those described for the first wipe. As for the method for impregnating the substrate with a sodium thio sulfate aqueous solution, the substrate can similarly be manufactured suitably by dipping the substrate into a sodium thiosulfate aqueous solution of a desired concentration and amount (which is larger than the amount to be impregnated).

(3) Third Wipe

The third wipe according to the present invention is impregnated with a sodium hydroxide aqueous solution. When an object to be wiped away is a medical agent such as an anticancer agent, wiping with this third wipe exerts an effect of floating and removing the medical agent. It is also effective in degrading an anticancer agent such as epirubicin.

The third wipe contains 4 to 110 mg of sodium hydroxide per gram of the wipe. This is because, if the third wipe contains less than 4 mg of sodium hydroxide per gram of the wipe, the capability to float and recover an adhered anticancer agent will be likely to be reduced, and if sodium hydroxide exceeds 110 mg, which is a high concentration, danger during a wiping operation and handling for disposal increases, which may deteriorate the wipe substrate and the packing material. It is noted that the content of sodium hydroxide contained in the third wipe per gram of the wipe can be checked by, for example, a titration method by adding phenolphthalein, or the like.

The substrate, size (area), thickness, surplus absorption capacity, and the like of the third wipe are similar to those described for the first wipe. A nonwoven fabric made of 100% polypropylene excellent in chemical resistance is most suitable. As for the method for impregnating the substrate with a sodium hydroxide aqueous solution, the substrate can similarly be manufactured suitably by dipping the substrate into a sodium hydroxide aqueous solution of a desired concentration and amount (which is larger than the amount to be impregnated).

The wipe set according to the present invention including the first, second and third wipes as described above can be used suitably for wiping away various objects. A particularly suitable object to be wiped away is an anticancer agent or a noxious medical agent having high bioactivity spilled or leaked on a working table, for example. The object to be wiped away can be removed with reliability even in a region of area approximately double that of conventional cases. A contribution to avoidance of health damage to an operator that would be caused by an anticancer agent can thereby be made. The anticancer agent as a suitable object to be wiped away is not particularly restricted, and the wipe set can be applied to wiping away conventionally-known various anticancer agents and noxious medical agents having high bioactivity, such as, for example, cyclophosphamide, epirubicin, carboplatin, cisplatin, fluorouracil, ifosfamide, melphalan, doxorubicin, idarubicin, pirarubicin, aclacinomycin, daunorubicin, etoposide, teniposide, bleomycin, mitomycin, and methotrexate.

The wipe set of the present invention is preferably provided in a manner that the first, second and third wipes described above are separately packed airtightly in a packing material and can be taken out from the packing material at the time of use. The material for forming the packing material used for the wipe set of the present invention is not particularly restricted. However, in order to maintain the concentration of the medical agents impregnated into the first, second and third wipes, respectively, and to avoid the danger of leakage of the medical agents, it is preferable to use a packing material including a layer made of aluminum having light blocking effect and barrier capability. A multilayer laminate sealed bag in which an olefin-based film excellent in medical agent stability is used for the surface to be in direct contact with a medical-agent-impregnated wipe is also desirable. Specifically, a bag-type article in which polyethylene (PE)/aluminum/PE layers are stacked in this order from the outer side to the inner side can be suitably used as the packing material.

Alternatively, in the wipe set of the present invention, the first wipe may be packed in a packing material configured such that the wipe substrate and the sodium hypochlorite aqueous solution are stored separately, and at the time of use, the substrate and the sodium hypochlorite aqueous solution are mixed to impregnate the substrate with the sodium hypochlorite aqueous solution, the second wipe may be packed in a packing material configured such that the wipe substrate and the sodium thiosulfate aqueous solution are stored separately, and at the time of use, the substrate and the sodium thiosulfate aqueous solution are mixed to impregnate the substrate with the sodium thiosulfate aqueous solution, and the third wipe may be packed in a packing material configured such that the wipe substrate and the sodium hydroxide aqueous solution are stored separately, and at the time of use, the substrate and the sodium hydroxide aqueous solution are mixed to impregnate the substrate with the sodium hydroxide aqueous solution. In this case, it is preferable to form the packing material of a material in which polyethylene (PE)/aluminum/PE layers are stacked as described above, and it is adapted to, at the time of use, impregnate the first wipe with a sodium hypochlorite aqueous solution, the second wipe with a sodium thiosulfate aqueous solution, and the third wipe with a sodium hydroxide aqueous solution in concentrations described above. In this case, the packing material for packing the first wipe is preferably formed in a manner that a sodium hydroxide aqueous solution is stored separately from storage chambers storing the substrate and a sodium hypochlorite aqueous solution, respectively, or stored in one of the storage chambers and is impregnated into the first wipe in the concentration described above at the time of use.

Figure 2:
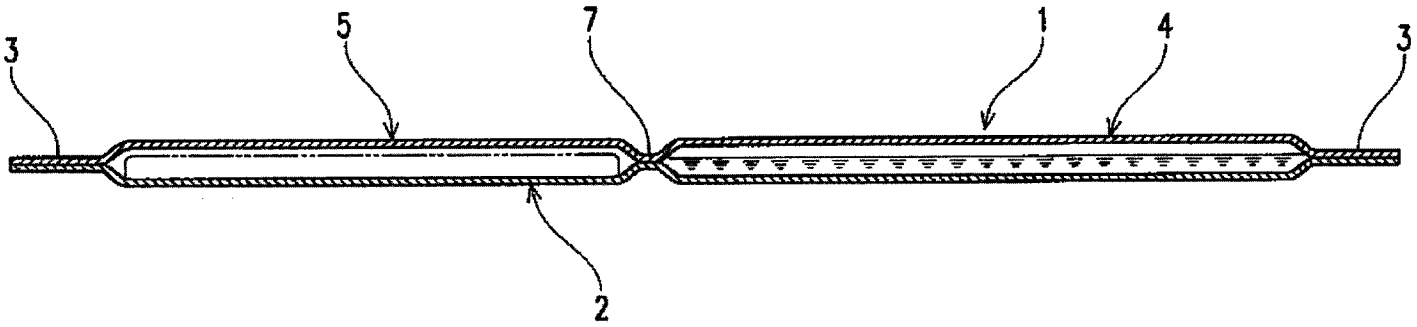
FIG. 2 is a sectional view schematically showing the packing material as the preferable example used for the wipe set of the present invention.

Here, FIGS. 1 and 2 schematically show a packing material of a preferable example used for the wipe set of the present invention. FIG. 1 is a plan view, and FIG. 2 is a sectional view. In a preferable packing material used for the wipe set of the present invention, two storage portions, each being capable of storing a filling in a manner enclosed by a sealed part 3 sealed with opposed sheets 1 and 2 overlapping each other, are formed as shown in FIGS. 1 and 2. Of the two storage portions, one storage portion is formed as a push-out-side storage portion 4 to which pressure is applied such that the filling is pushed out. The other storage portion is formed as an introduced-side storage portion 5 in which the filling in the push-out-side storage portion is to be introduced. A barrier sealed part 6 configured to be peelable so as to bring push-out-side storage portion 4 and introduced-side storage portion 5 into communication by depression of push-out-side storage portion 4 is formed between push-out-side storage portion 4 and introduced-side storage portion 5. At the leading end side of push-out-side storage portion 4 and the leading end side of introduced-side storage portion 5, a recess 8 and a projection 9 opposed to each other are formed, respectively. The leading edge of opposed introduced-side storage portion 5 is formed to be located on the push-out-side storage portion 4 side with respect to the leading edge of push-out-side storage portion 4, so that projection 9 appears in recess 8. Barrier sealed part 6 between projection 9 and recess 8 is formed as a connection sealed part 7 for connecting push-out-side storage portion 4 and introduced-side storage portion 5. Through the use of such a packing material, a compressive force applied to push-out-side storage portion 4 can be effectively exerted on the central part where the leading ends of push-out-side storage portion 4 and introduced-side storage portion 5 are opposed to each other. The filling of push-out-side storage portion 4 can be introduced suitably into introduced-side storage portion 5 without the possibility that a peel-off portion of barrier sealed part 6 created by the compressive force appears at a position offset from the central part.

In the case of using such a packing material, it is preferable to store, in push-out-side storage portion 4, a sodium hypochlorite aqueous solution (and a sodium hydroxide aqueous solution according to necessity) (in the case of the first wipe), a sodium thiosulfate aqueous solution (in the case of the second wipe) or a sodium hydroxide aqueous solution (in the case of the third wipe) to be impregnated into a wipe, and to store the wipe substrate in introduced-side storage portion 5.

<Wiping Method>

The present invention also provides a wiping method in which the wipe set of the present invention described above is used. The wiping method of the present invention includes the following first, second and third methods.

The order of wiping which will be described herein is determined for the purpose of effectively utilizing both effects of chemical degradation capability and physical removal capability of the wipe according to the present invention to achieve quick removal in a short time. As will be shown specifically in experimental examples which will be described later, chemical degradation capability differs in degradation time depending on the type and concentration of an anticancer agent. For an anticancer agent that is degraded instantaneously, only a chemical effect may be sufficient. On the other hand, for an anticancer agent that requires a relatively long time for degradation, the effect of removing the anticancer agent from a contaminated surface needs to be increased by physical removal in addition to the chemical effect. The wiping method of the present invention is a method for effectively removing an anticancer agent from a contaminated surface whether the degradation reaction is quick or slow.

(1) First Method

The first method of the present invention is a wiping method through use of the above-described wipe set of the present invention, and is characterized by including the steps of wiping with the first wipe, wiping with the second wipe a trace of wiping with the first wipe, and wiping with the third wipe a trace of wiping with the second wipe. Through such steps, an object to be wiped away (particularly suitably, an anticancer agent) can be removed effectively as will be shown specifically in experimental examples which will be described later.

Here, in the case of wiping only with the first wipe without wiping with the second and third wipes, the first wipe will exert its maximum effect in terms of chemical degradation capability. However, in the case of an anticancer agent which takes time for degradation, such as cyclophosphamide, in the case of highly concentrated contamination, and in the case where the wiping interval is short, chemical degradation cannot be completed in some cases. Moreover, with the first wipe alone, an adverse effect that the metal surface of a working table will be eroded by the oxidation corrosion action of sodium hypochlorite cannot be prevented. In the case of wiping with the first wipe and the second wipe in this order without wiping with the third wipe, if chemical degradation by the first wipe is insufficient as described above, a neutralization reaction will take place on the wiped surface by the wiping operation with the second wipe, which will counteract the anticancer-agent inactivation effect of the first agent. As a result, the anticancer agent left on the wiped surface will not be degraded completely. Therefore, the operation of removing an object to be wiped away will be insufficient and incomplete.

In the case of wiping with the first wipe and then wiping with the third wipe without wiping with the second wipe, this combination allows degradation capability to be maintained without the third wipe counteracting the anticancer-agent inactivation effect of the first wipe, but neutralization of the residue after wiping with the first wipe will be insufficient, so that the working table may be damaged. In the case of wiping only with the second wipe without wiping with the first wipe or in the case of wiping with the second wipe and then wiping with the third wipe without wiping with the first wipe, a residual may occur because the degradation capability of the second wipe used alone is weak. In this case, since neither the second wipe nor the third wipe may exert the inactivation effect on a certain type of anticancer agents, removal of an object to be wiped away may be insufficient. It is noted that wiping only with the second wipe and wiping with the second wipe and then wiping with the third wipe without wiping with the first wipe are both not preferable as options from the viewpoint that it is not essential to use the second wipe in advance because the second wipe is used supplementally for the effect of neutralizing sodium hypochlorite contained in the first wipe.

In the first method, the most part can be removed by the combination of the chemical degradation capability and the physical removal capability at the time of wiping with the first wipe. The anticancer agent consequently moved to the first wipe, even if not completely degraded at that time, continues to degrade in a wipe waste. Thus, toxicity reduction in the waste can be expected. The anticancer agent left on the working table, even if incompletely degraded by sodium hypochlorite contained in the first wipe, can be wiped away and removed effectively by the steps of completing neutralization with the second wipe and physically removing the residue of the remaining anticancer agent with the third wipe.

(2) Second Method

The second method of the present invention is a wiping method through use of the above-described wipe set of the present invention, and is characterized by including the steps of wiping with the third wipe, wiping with the first wipe a trace of wiping with the third wipe, and wiping with the second wipe a trace of wiping with the first wipe. Through such steps, an object to be wiped away (particularly suitably, an anticancer agent) can be removed effectively as will be shown specifically in experimental examples which will be described later.

Here, in the case of wiping only with the third wipe without wiping with the first and second wipes, sodium hydroxide contained in the third wipe does not have very high chemical degradation capability, but presents physical removal capability that can achieve removal to a degree equivalent to the chemical degradation capability exerted by the first wipe. With the third wipe alone, however, this physical removal prevails, and the residue not having been absorbed into the wipe and the anticancer agent on the wipe surface will contribute to a uniformized concentration on the wipe surface by the wiping operation, so that complete wiping may become difficult. In the case of wiping with the third wipe and the first wipe in this order without wiping with the second wipe, the anticancer agent left on the wiped surface after the physical removal with the third wipe is reduced in concentration, so that a relative concentration of sodium hypochlorite contained in the subsequent first wipe with respect to the anticancer agent will increase, resulting in more effective chemical degradation. However, an adverse effect that the metal surface of the working table will be eroded by the oxidation corrosion action of sodium hypochlorite by interruption of the wiping operation with the first wipe cannot be prevented. In the case of wiping with the third wipe and then wiping with the second wipe without wiping with the first wipe, a residual occurs because the degradation capability of sodium thiosulfate contained in the second wipe is weak. Thus, removal of an object to be wiped away will be insufficient.

In the second method, at the time of wiping with the third wipe, the most part can be removed by its physical removal capability. As a result, it can be expected to reduce the concentration of the anticancer agent left on the wiped surface and to relatively increase the chemical degradation capability in the subsequent wiping operation with the first wipe. In the second method, the residue after wiping with the first wipe is neutralized by the second wipe, so that the wiping operation can be completed effectively.

(3) Third Method

The third method of the present invention is a wiping method through use of the above-described wipe set of the present invention, and is characterized by including the steps of wiping with the first wipe, wiping with the third wipe a trace of wiping with the first wipe, and wiping with the second wipe a trace of wiping with the third wipe. Through such steps, an object to be wiped away (particularly suitably, an anticancer agent) can also be removed effectively, as will be shown specifically in experimental examples which will be described later.

Here, in the case of wiping with the first wipe and the third wipe in this order without wiping with the second wipe, the neutralizing action on the residue left after wiping with the first wipe on the working table will not be completed. Therefore, the operation of removing an object to be wiped away may be insufficient and incomplete.

In the third method, even if degradation by sodium hypochlorite contained in the first wipe is incomplete, the anticancer-agent inactivation effect of the first wipe is maintained by subsequently using the third wipe having compatibility with sodium hypochlorite and anticancer-agent inactivation. Then, the working table is neutralized by the wiping operation with the second wipe.

In any of the first, second and third methods of the present invention, it is preferable to perform the respective steps at an interval of at least 60 seconds, more preferably at an interval of 60 to 120 seconds. This is because, if the interval between the respective steps is less than 60 seconds, a medical agent impregnated into a wipe used in a previous step may not be fully dried, which may arise problems, such as a decreased degradation rate of the anticancer agent by sodium hypochlorite contained in the first wipe and an insufficient neutralization reaction time by sodium thiosulfate contained in the second wipe.

It is noted that the methods of the present invention shall be used only for cleaning of a surface treated so as not to suffer from chemical changes, such as a working table for preparing a medical agent, and shall not be applied to an article made of resin. In use, a rubber glove or the like should always be worn to prevent the skin from directly contacting the wipes. It is preferable to carry out the methods of the present invention in a fully ventilated environment such that one may not inhale chlorine vapor when taking out the first wipe from the packing material. It is also preferable to carry out the methods of the present invention wearing a mask, an eye protector and the like, similarly to the time of preparation of a medical agent.

While the present invention will be described below in detail citing experimental examples, the present invention is not limited to them.

Experimental Example 1: Trial Production of Medical-Agent-Impregnated Wipe

[1] Considerations

In order to produce wipes impregnated with a sodium hypochlorite aqueous solution, a sodium thiosulfate aqueous solution and a sodium hydroxide aqueous solution, respectively, consideration was given to the materials of wipe substrates and stable formulation of medical agents.

[2] Selection of Wipe Substrate

In order to check the resistance of a wipe substrate to a medical agent, a 6% sodium hypochlorite aqueous solution (60 g/L) as the first agent, 0.185 mol/L of a sodium thiosulfate aqueous solution as the second agent, and 0.65 mol/L of a sodium hydroxide aqueous solution as the third agent were prepared. Into a screw bottle, 50 mL of each medical agent was put, into which four types of commercial wipes equivalent to 0.4 g made of cellulose, cotton, polyester, and polypropylene, respectively, were immersed, and kept at 50° C. for three weeks. The appearances were evaluated. Next, in order to check medical agent stability, wipe substrates selected in appearance evaluation were used, and 20 mL of each medical agent was put into containers made of polypropylene, into which wipes equivalent to 0.4 g were immersed. Changes in concentration with time were checked while keeping at 50° C.

[3] Results

The results of appearance check of four types of commercial wipes are shown in Table 1. As for the nonwoven fabrics of cellulose and cotton, yellowing and/or dissolution were/was observed as a result of contact with the first and third agents. Furthermore, as for the nonwoven fabrics of polyester and polypropylene in which anomaly was not observed in the results shown in Table 1, the results of changes in concentration with the first agent are shown in Table 2, the results of changes in concentration with the second agent are shown in Table 3, and the results of changes in concentration with the third agent are shown in Table 4. These results reveal that polyester reacted with the liquid agents of the first and third agents to show the tendency toward decrease in concentration and brought about dissolution of the nonwoven fabric, while the nonwoven fabric of polypropylene was most stable with the first, second, and third agents.

TABLE 1

| Wipe Substrate | | Additive Medical Agent | | |
|---|---|---|---|---|
| | | First Agent | Second Agent | Third Agent |
| Material | Product No. | Hypochlorite Na | Thiosulfate Na | Hydroxide Na |
| cellulose | 7155A | yellowing, dissolution | — | yellowing |
| cotton | C080S | dissolution | — | dissolution |
| polyester | LTK2010 | — | — | — |
| polypropylene | 33309 | — | — | — |

TABLE 2

| | | Medical Agent First Agent (Hypochlorite Na) Wipe Substrate | | |
|---|---|---|---|---|
| Keeping Condition | Lapsed Days | — | polyester | polypropylene |
| | | Effective Chlorine Concentration (%) | | |
| 50° C. | 0 | 5.88 | 5.88 | 5.88 |
| | 7 | 4.35 | 0.08 | 3.88 |
| | 21 | 2.84 | 0 | 1.46 |
| | 44 | 1.56 | 0 | 0.02 |

TABLE 3

| | | Medical Agent Second Agent (Thiosulfate Na) Wipe Substrate | | |
|---|---|---|---|---|
| Keeping Condition | Lapsed Days | — | polyester | polypropylene |
| | | Effective Concentration (mol/L) | | |
| 50° C. | 0 | 0.185 | 0.185 | 0.185 |
| | 7 | 0.183 | 0.189 | 0.177 |
| | 21 | 0.187 | 0.189 | 0.177 |
| | 44 | 0.177 | 0.189 | 0.175 |

TABLE 4

| | | Medical Agent Third Agent (Hydroxide Na) Wipe Substrate | | |
|---|---|---|---|---|
| Keeping Condition | Lapsed Days | — | polyester | polypropylene |
| | | Effective Concentration (mol/L) | | |
| 50° C. | 0 | 0.65 | 0.65 | 0.65 |
| | 7 | 0.65 | 0.37 | 0.65 |
| | 21 | 0.65 | 0.21 | 0.65 |
| | 44 | 0.65 | 0.05 | 0.65 |

[4] Formulation of Medical Agent for First Wipe

Polypropylene is superior to the other wipe substrates in stability of the first agent (sodium hypochlorite), however, the results of Table 2 show that the concentration decrease is larger than in the case of the medical agent alone, which arises concern about a shorter expiration period. While sodium hypochlorite inherently has a nature that is unstable and easy to degrade, if it becomes more acidic due to underwater distribution of chloric acid and hypochlorous acid corresponding to the changes in temperature and pH value (by Morris J. C.), it will rapidly produce a degradation reaction to generate a chlorine gas. Therefore, to 1 L of 5% sodium hypochlorite, small amounts of 0 g, 1 g, 2.5 g, 10 g, 30 g, and 50 g of sodium hydroxide were added to prepare the first agent. To the wipe substrate made of polypropylene, 15 mL of the first agent was added to produce a medical-agent-impregnated wipe. Each wipe was input to a lamination barrier packing material made of aluminum and olefin. The effective chlorine concentration was evaluated with time under the keeping condition of 50° C.

[5] Results

The tendency in effective chlorine concentration of each trial wipe is shown in Table 5. These results revealed that addition of sodium hydroxide is effective in maintaining the effective chlorine concentration in the first wipe, and that the range of 2.5 g/L to 30 g/L is effective. According to observation of the internal and external surfaces of the packing material, oxidation degradation in an aluminum foil of the packing material was observed after 21 days of a sample in which sodium hydroxide was not add and at the lapse of 32 days of a sample in which a small amount of 1 g/L of sodium hydroxide was added. Deterioration of the packing material was not observed in the remaining samples. From the above results, it was determined that, for the medical agent formulation of the first wipe (first agent formulation), 1% (wt/v) sodium hydroxide was added to sodium hypochlorite.

TABLE 5

| Sodium Hypochlorite Solution | | Effective Chlorine Concentration (%) | | | | | |
|---|---|---|---|---|---|---|---|
| Keeping | Lapsed | Amount of Added Sodium Hypochlorite (g/L) | | | | | |
| Condition | Days | 0 | 1 | 2.5 | 10 | 30 | 50 |
| 50° C. | 0 | 4.83 | 4.99 | 5.05 | 5.07 | 4.96 | 4.93 |
| | 7 | 3.77 | 3.87 | 3.88 | 3.91 | 3.60 | 3.34 |
| | 14 | 0.99 | 3.17 | 3.30 | 3.16 | 2.83 | 2.53 |
| | 21 | 0.12 | 2.42 | 2.74 | 2.70 | 2.47 | 2.01 |
| | 32 | 0.00 | 0.92 | 2.39 | 2.34 | 2.00 | 1.66 |

Experimental Example 2: Chemical Degradation Capability of Additive Medical Agent Relative to 500 ppm of Anticancer Agent, Cyclophosphamide

[1] End-Points

In order to check the chemical degradation capability of three medical agents to be added to a wipe relative to an anticancer agent, the content of the anticancer agent was measured 1) after performing single mixture of each of the three medical agents to an anticancer agent solution, 2) after mixing the first agent to the anticancer agent solution and then sequentially mixing the second agent, and 3) after mixing the first agent to the anticancer agent solution, then sequentially mixing the second agent and further mixing the third agent. The chemical degradation capabilities possessed by the respective medical agents were thereby compared. For the sequential mixture, dominance of the degradation effect depending on the order of addition of medical agents was considered.

[2] Method

As a specimen, an anticancer agent, cyclophosphamide (100 mg of Endoxan for injection provided by Shionogi & Co., Ltd., serial no. 4248) was used. As the three medical agents to be added thereto, a sodium hypochlorite aqueous solution (two levels of 5% of high concentration and 2% of low concentration were prepared, to each of which 1% wt/v sodium hydroxide was added) was prepared as the first agent. A sodium thiosulfate aqueous solution (0.17 mol/L) was prepared as the second agent. A sodium hydroxide aqueous solution (0.8 mol/L) was prepared as the third agent. In the single mixture and sequential mixture of the anticancer agent and the medical agents, mixing was followed by stirring for 10 seconds and the mixture was left for 20 seconds, which means that the mixing interval was set at 30 seconds.

In the measuring method, cyclophosphamide was dissolved in water, and water was further added thereto after dissolution to be adjusted to 1000 ppm, thereby obtaining an anticancer agent concentrated solution. Then, 2 mL, 3 mL, 4 mL, 5 mL, and 6 mL of this solution were accurately weighed out, and water was added to be adjusted to 10 mL, thereby obtaining a solution for standard curve. As separately shown in Table 6, 5 mL of the anticancer agent concentrated solution was accurately weighed out and each liquid agent was added thereto sequentially. Water was then added to be adjusted to 10 mL, thereby obtaining a sample solution. In any case, a measurement was conducted on 25 μL of each of the sample solution and the solution for standard curve by liquid chromatography under the following conditions to obtain the content of cyclophosphamide from the equation of the standard curve. It is noted that, in the mixing test of each single agent of Samples 1 to 4 and cyclophosphamide shown in Table 6, the cyclophosphamide content at the lapse of about 60 minutes or more up to the measurement after the mixing was evaluated. For Samples 1, 2 and Samples 5 to 10, the cyclophosphamide content was evaluated at the lapse of 10 minutes or less up to the measurement after the final mixing was evaluated.

TABLE 6

| | Anticancer | Additive Medical Agent | |
|---|---|---|---|
| Sample | Agent | Additive Medical Agent | Added Amount |
| 1 | 5 mL | First Agent (high concentration) | 1 mL |
| 2 | | First Agent (low concentration) | 1 mL |
| 3 | | Second Agent | 1 mL |
| 4 | | Third Agent | 1 mL |
| 5 | | First Agent (high concentration) → Second Agent | 2 mL (1 mL each) |
| 6 | | First Agent (high concentration) → Third Agent | 2 mL (1 mL each) |
| 7 | | First Agent (high concentration) → Second Agent → Third Agent | 3 mL (1 mL each) |

TABLE 6-continued

| | Anticancer | Additive Medical Agent | |
|---|---|---|---|
| Sample | Agent | Additive Medical Agent | Added Amount |
| 8 | | First Agent (low concentration) → Second Agent | 2 mL (1 mL each) |
| 9 | | First Agent (low concentration) → Third Agent | 2 mL (1 mL each) |
| 10 | | First Agent (low concentration) → Second Agent → Third Agent | 3 mL (1 mL each) |

(Test Conditions)

Detector: ultraviolet absorptiometer (measuring wavelength: 195 nm)

Column: a stainless pipe of 4.6 mm in inner diameter and 25 cm in length filled with 5 μm of an octadecylsilanized silica gel for liquid chromatography Column temperature: constant temperature around 40° C.

Mobile phase: a mixed solution of 0.05 mol/L of a phosphate buffer*[1]/acetonitrile (8:2) (*1: 6.84 g of sodium dihydrogen phosphate dihydrate and 2.20 g of sodium dihydrogen phosphate dodecahydrate were dissolved in water to be adjusted to 1000 mL)

Flow rate: 1.5 mL/min

Injection rate: 25 μL (Used Instruments)

High-performance liquid chromatographic system: L-2000 (Hitachi High-Technologies, Ltd.)

Electronic balance: AT200 (provided by Mettler-Toledo International Inc.), XS205 (provided by Mettler-Toledo International Inc.)

[3] Results

For the mixing test of cyclophosphamide and each additive medical agent of Samples 1 to 4, the results of the content (%) obtained from the standard curve of cyclophosphamide at the lapse of 60 minutes or more and the degradation rate (%) relative to the initial concentration are shown in Table 7. For the sequential mixture of Sample 1 and Samples 5 to 7, the results of the content (%) obtained from the standard curve of cyclophosphamide at the lapse of less than 10 minutes and the average degradation rate (%) relative to the initial concentration are shown in Table 8. For the sequential mixture of Sample 2 and Samples 8 to 10, the results of the content (%) obtained from the standard curve of cyclophosphamide at the lapse of less than 10 minutes and the average degradation rate (%) relative to the initial concentration are shown in Table 9.

TABLE 7

| Sample | Anticancer Agent | Additive Medical Agent | Lapsed Time (min) | Concentration Obtained From Standard Curve of Cyclophosphamide (%) | Degradation Rate Relative to Initial Concentration (%) |
|---|---|---|---|---|---|
| — | Cyclo-phosphamide | — | 60 | 100.1 | 0.0 |
| 1 | | First Agent (high concentration) | 60 | 2.4 | 97.6 |
| | | | 160 | 1.8 | 98.2 |
| | | | 250 | 0.9 | 99.1 |
| 2 | | First Agent (low concentration) | 90 | 28.1 | 71.9 |
| | | | 180 | 23.2 | 76.8 |
| | | | 270 | 17.9 | 82.1 |
| 3 | | Second Agent | 120 | 99.2 | 0.8 |
| | | | 210 | 99.3 | 0.7 |
| | | | 290 | 98.9 | 1.1 |
| 4 | | Third Agent | 140 | 99.4 | 0.6 |
| | | | 230 | 98.0 | 2.0 |
| | | | 310 | 98.5 | 1.5 |

TABLE 8

| Sample | Anticancer Agent | Order of Addition of Additive Medical Agent(s) | Lapsed Time (min) | Concentration Obtained From Standard Curve of Cyclophosphamide (%) | Average Degradation Rate Relative to Initial Concentration (%) |
|---|---|---|---|---|---|
| — | Cyclo- | — | <10 | 99.8 | — |
| 1 | phosphamide | First Agent | <10 | 42.1 | 57.8 |
| | | (high concentration) | <10 | 42.3 | |
| | | | <10 | 42.3 | |
| 5 | | First Agent | <10 | 99.2 | 0.6 |
| | | (high concentration) → | <10 | 99.7 | |
| | | Second Agent | <10 | 99.3 | |
| 6 | | First Agent | <10 | 57.6 | 43.4 |
| | | (high concentration) → | <10 | 57.7 | |
| | | Third Agent | <10 | 54.4 | |
| 7 | | First Agent | <10 | 99.7 | 0.0 |
| | | (high concentration) → | <10 | 100.2 | |
| | | Second Agent → Third Agent | <10 | 100.2 | |

TABLE 9

| Sample | Anticancer Agent | Order of Addition of Additive Medical Agent(s) | Lapsed Time (min) | Concentration Obtained From Standard Curve of Cyclophosphamide (%) | Average Degradation Rate Relative to Initial Concentration (%) |
|---|---|---|---|---|---|
| — | cyclo- | — | <10 | 99.7 | — |
| 2 | phosphamide | First Agent | 15 | 65.0 | 32.7 |
| | | (low concentration) | <10 | 68.6 | |
| | | | <10 | 68.5 | |
| 8 | | First Agent | <10 | 97.5 | 0.8 |
| | | (low concentration) → | <10 | 100.2 | |
| | | Second Agent | <10 | 99.8 | |
| 9 | | First Agent | <10 | 81.1 | 18.8 |
| | | (low concentration) → | <10 | 80.9 | |
| | | Third Agent | <10 | 81.7 | |
| 10 | | First Agent | <10 | 99.6 | 0.1 |
| | | (low concentration) → | <10 | 99.8 | |
| | | Second Agent→Third Agent | <10 | 100.4 | |

From the results of Table 7, as for the cyclophosphamide content at the lapse of 60 minutes or more after adding each of the first, second and third agents to cyclophosphamide, decrease in the content was observed in the cases of the first agent of high concentration and the first agent of low concentration. In the cases of the second and third agents, decrease in the content was hardly observed. It was also revealed that the decrease in concentration varied depending on the difference in concentration of the first agent and the difference in lapsed time, and degradation is promoted as the concentration becomes higher and the lapsed time becomes longer.

From the results of Tables 8 and 9, as for the cyclophosphamide content at the lapse of less than 10 minutes after mixing the first agent alone to cyclophosphamide and after sequentially mixing the first agent and other medical agents to cyclophosphamide, decrease in the content was observed in the cases of the first agent (single mixture) and the first and third agents (sequential mixture). For sequential mixture of the first and second agents and sequential mixture of the first, second and third agents, decrease in the content was not observed.

From the above results, it was confirmed that the first agent had an inactivation effect on cyclophosphamide. As the first agent has a higher concentration, the degradation time can be shorter. On the other hand, it was suggested that the second agent serves to counteract the inactivation effect of the first agent. In this test system, as for the final concentration after mixing, cyclophosphamide was 500 ppm, while each additive medical agent became 1/10 of a target concentration. Therefore, each medical agent can be substantially considered as having chemical degradation capability with respect to a relative concentration of 5000 ppm of cyclophosphamide.

Experimental Example 3: Chemical Degradation Capability of Additive Medical Agent Relative to Various Types of Anticancer Agents of Concentration Equivalent to Usual Contamination Level

[1] End-Points

In order to check the chemical degradation capability of an additive medical agent relative to an anticancer agent having a concentration equivalent to a contamination level detected in the medical field (considered to be about 1.0 ng/cm$^2$ at a high contamination level, and a preparation area is approximately 3500 cm$^2$), the content of the anticancer agent was measured 1) after performing single mixture of an anticancer agent solution and each of the three medical agents, 2) after mixing the first agent to the anticancer agent solution and then sequentially mixing the second agent, and 3) after mixing the first agent to the anticancer agent solution, then sequentially mixing the second agent and further the third agent. The chemical degradation capabilities possessed by the respective medical agents were thereby compared. For the sequential mixture, dominance of the degradation effect depending on the order of addition of medical agent(s) was considered. Besides cyclophosphamide, epirubicin, carboplatin, cisplatin, and fluorouracil as general-purpose anticancer agents were considered as the anticancer agent.

[2] Method

As the anticancer agent used as a specimen, cyclophosphamide (Shionogi& Co., Ltd., Endoxan Lot 4248, an epirubicin raw drug (provided by Sicor Inc.), a carboplatin raw drug (provided by Heraeus Holding GmbH), and a cisplatin raw drug (provided by Heraeus Holding GmbH) were prepared. The concentration of each anticancer agent was prepared so as to have a contamination level equivalent concentration after mixing. For the three additive medical agents, a 5% sodium hypochlorite aqueous solution (containing 2.5% sodium hydroxide) was prepared as the first agent, 1.7 mol/L of a sodium thiosulfate aqueous solution was prepared as the second agent, and 8 mol/L of a sodium hydroxide aqueous solution was prepared as the third agent such that the final concentration after mixing becomes a target concentration. Each anticancer agent and three medical agents were combined in accordance with the list of additive medical agents shown in Table 10. In the single mixture and sequential mixture, one medical agent was mixed while stirring for 10 seconds and left for 50 seconds, which means that each interval was set at 60 seconds.

TABLE 10

| | Anticancer | Additive Medical Agent | |
|---|---|---|---|
| Sample | Agent | Order of Addition | Added Amount |
| 1 | 1 mL of | First Agent | 4 mL |
| 2 | Each | Second Agent | 1 mL |
| 3 | Medical | Third Agent | 1 mL |
| 4 | Agent | First Agent → | 5 mL (4 mL of First Agent, |
| | | Second Agent | 1 mL of Second Agent) |
| 5 | | First Agent → | 5 mL (4 mL of First Agent, |
| | | Third Agent | 1 mL of Third Agent) |
| 6 | | First Agent → | 6 mL (4 mL of First Agent, |
| | | Second Agent → | 1 mL of Second Agent, |
| | | Third Agent | 1 mL of Third Agent) |
| 7 | | Third Agent → | 6 mL (4 mL of First Agent, |
| | | First Agent → | 1 mL of Second Agent, |
| | | Second Agent | 1 mL of Third Agent) |

The concentration of each anticancer agent was planned to be considered assuming the contamination level to be 3.5 μg/mL, however, as a result of confirming the detection peak by preliminary analysis, the concentration that can be detected in each anticancer agent and the optimum technique were used.

As for cyclophosphamide and epirubicin, the final concentration after mixing is 3.5 μg/mL. As for the concentration of additive medical agents, the final concentration after mixing of the first agent was 2% (containing 1% sodium hydroxide), the final concentration after mixing of the second agent was 0.17 mol/L, and the final concentration after mixing of the third agent was 0.8 mol/L.

As for cisplatin and carboplatin, since detection could not be made at 3.5 μg/mL, measurement was intended to be made at a high concentration, but the peak shape was bad, which was not suitable for calculating the content. Therefore, acetonitrile was used in the last procedure to dilute them tenfold, so that measurement could be made. The final concentrations of cisplatin and carboplatin after mixing were 10 μg/mL and 20 μg/mL, respectively. As for the concentration of additive medical agents, the final concentration after mixing of the first agent was 0.2%, the final concentration after mixing of the second agent was 0.017 mol/L, and the final concentration after mixing of the third agent was 0.08 mol/L.

As for fluorouracil, evaluation was given up because the elution peak of fluorouracil overlapped the elution peak of the additive medical agents in measurement of high performance liquid chromatography, and measurement could not be made.

<Method for Measuring Cyclophosphamide>

Cyclophosphamide was dissolved in water and prepared to be 35 μg/mL, thereby obtaining an anticancer agent concentrated solution. Using this solution, water was added and prepared so as to correspond to 1.4 μg/mL, 2.1 μg/mL, 2.8 μg/mL, 3.5 μg/mL, and 4.2 μg/mL, thereby obtaining solutions for standard curve. In accordance with the list of additive medical agents shown separately in Table 10, 1 mL of the anticancer agent concentrated solution was accurately weighed out, and each additive medical agent was added thereto. Then, water was added to be accurately adjusted to 10 mL, thereby obtaining a sample solution. A test was conducted on 95 μL of each of the sample solution and the solution for standard curve by liquid chromatography under the following conditions to obtain the cyclophosphamide content from the equation of the standard curve. The lapsed time up to the measurement after the final mixing was set at 2 minutes to 3 minutes equivalent to the wipe wiping operation time.

(Test Conditions)

Detector: ultraviolet absorptiometer (measuring wavelength: 195 nm)

Column: a stainless pipe of 4.6 mm in inner diameter and 25 cm in length filled with 5 μm of an octadecylsilanized silica gel for liquid chromatography Column temperature: constant temperature around 40° C.

Mobile phase: a mixed solution of 0.05 mol/L of a phosphate buffer*1/acetonitrile (8:2) (*1: 6.84 g of sodium dihydrogen phosphate dihydrate and 2.20 g of sodium dihydrogen phosphate dodecahydrate were dissolved in water to be adjusted to 1000 mL)

Flow rate: 1.5 mL/min

Injection rate: 95 μL (Used Instruments)

High-performance liquid chromatographic system: L-2000 (Hitachi High-Technologies, Ltd.)

Electronic balance: XS205 (provided by Mettler-Toledo International Inc.)

<Method for Measuring Epirubicin>

Epirubicin was dissolved in water and prepared to be 35 μg/mL, thereby obtaining an anticancer agent concentrated solution. Using this solution, water was added and prepared so as to correspond to 1.4 μg/mL, 2.1 μg/mL, 2.8 μg/mL, 3.5 μg/mL, and 4.2 μg/mL, thereby obtaining a solution for standard curve. In accordance with the list of additive medical agents shown separately in Table 10, 1 mL of the anticancer agent concentrated solution was accurately weighed out, and each additive medical agent was added. Then, water was added to be accurately adjusted to 10 mL, thereby obtaining a sample solution. A test was conducted on 50 μL of each of the sample solution and the solution for standard curve by liquid chromatography under the following conditions to obtain the epirubicin content from the equation of the standard curve. The lapsed time up to the measurement after the final mixing was set at 2 minutes to 3 minutes equivalent to the wipe wiping operation time.

(Test Conditions)

Detector: ultraviolet absorptiometer (measuring wavelength: 254 nm)

Column: a stainless pipe of 4.6 mm in inner diameter and 25 cm in length filled with 5 μm of an octadecylsilanized silica gel for liquid chromatography.

Column temperature: constant temperature around 35° C.

Mobile phase: 2 g of sodium lauryl sulfate was weighed out, and a mixed solution of water/acetonitrile/methanol/phosphoric acid (450:300:250:1) was added thereto and dissolved to be adjusted to 1,000 mL Flow rate: 1.0 mL/min Injection rate: 50 μL (Used Instruments)

High-performance liquid chromatographic system: L-2000 (Hitachi High-Technologies, Ltd.)

Electronic balance: AT200 (provided by Mettler-Toledo International Inc.), XS205 (provided by Mettler-Toledo International Inc.)

<Method for Measuring Cisplatin>

Cisplatin was dissolved in water and prepared to be 1000 μg/mL, thereby obtaining an anticancer agent concentrated solution. Using this solution, water was added and prepared so as to correspond to 40 μg/mL, 60 μg/mL, 80 μg/mL, 100 μg/mL, and 120 μg/mL. Then, 1 mL of these solutions were accurately weighed out, and acetonitrile was added to be adjusted to 10 mL, thereby obtaining a solution for standard curve. In accordance with the list of additive medical agents shown separately in Table 10, 1 mL of the anticancer agent concentrated solution was accurately weighed out, and each additive medical agent was added. Then, water was added to be accurately adjusted to 10 mL, thereby obtaining a sample solution. A test was conducted on 20 μL of each of the sample solution and the solution for standard curve by liquid chromatography under the following conditions to obtain the cisplatin content from the equation of the standard curve. The lapsed time up to the measurement after the final mixing was set at 2 minutes to 3 minutes equivalent to the wipe wiping operation time.

(Test Conditions)

Detector: ultraviolet absorptiometer (measuring wavelength: 210 nm)

Column: a stainless pipe of 4.6 mm in inner diameter and 15 cm in length filled with 5 μm of an octadecylsilanized silica gel for liquid chromatography Column temperature: constant temperature around 30° C.

Mobile phase: mixed solution of acetonitrile/water (19:1)

Flow rate: 0.7 mL/min

Injection rate: 20 μL (Used Instruments)

High-performance liquid chromatographic system: L-2000 (Hitachi High-Technologies, Ltd.)

Electronic balance: XS205 (provided by Mettler-Toledo International Inc.)

<Method for Measuring Carboplatin>

Carboplatin was dissolved in water and prepared to be 2000 μg/mL, thereby obtaining an anticancer agent concentrated solution. Using this solution, water was added and prepared so as to correspond to 80 μg/mL, 120 μg/mL, 160 μg/mL, 200 μg/mL, and 240 μg/mL. Then, 1 mL of these solutions was accurately weighed out, and acetonitrile was added to be adjusted to 10 mL, thereby obtaining a solution for standard curve. In accordance with the list of additive medical agents shown separately in Table 10, 1 mL of the anticancer agent concentrated solution was accurately weighed out, and each additive medical agent was added. Then, water was added to be accurately adjusted to 10 mL. Then, 1 mL of this solution was accurately weighed out, and acetonitrile was added to be adjusted to 10 mL, thereby obtaining a sample solution. A test was conducted on 20 μL of each of the sample solution and the solution for standard curve by liquid chromatography under the following conditions to obtain the cisplatin content from the equation of the standard curve. The lapsed time up to the measurement after the final mixing was set at 2 minutes to 3 minutes equivalent to the wipe wiping operation time.

(Test Conditions)

Detector: ultraviolet absorptiometer (measuring wavelength: 230 nm)

Column: a stainless pipe of 4.6 mm in inner diameter and 25 cm in length filled with 5 μm of an octadecylsilanized silica gel for liquid chromatography Column temperature: constant temperature around 30° C.

Mobile phase: mixed solution of acetonitrile/water (4:1)

Flow rate: 1.0 mL/min

Injection rate: 20 μL (Used Instruments)

High-performance liquid chromatographic system: L-2000 (Hitachi High-Technologies, Ltd.)

Electronic balance: XS205 (provided by Mettler-Toledo International Inc.)

[6] Results

As for the single agent mixture and sequential mixture test of cyclophosphamide and each additive medical agent of Samples 1 to 7, the content (%) obtained from the standard curve of cyclophosphamide and the degradation rate (%) relative to the initial concentration are shown in Table 11. As for the single agent mixture and sequential mixture test of epirubicin and Samples 1 to 7, the content (%) obtained from the standard curve of epirubicin and the degradation rate (%) relative to the initial concentration are shown in Table 12. As for the single agent mixture and sequential mixture test of cisplatin and Samples 1 to 7, the content (%) obtained from the standard curve of cisplatin and the degradation rate (%) relative to the initial concentration are shown in Table 13. As for the single agent mixture and sequential mixture test of carboplatin and Samples 1 to 7, the content (%) obtained from the standard curve of cisplatin and the degradation rate (%) relative to the initial concentration are shown in Table 14. A comparison table of the average degradation rates (%) of various anticancer agents by the additive medical agents considered (single agent mixture, mixture of two types of medical agents, mixture of three types of medical agents) is shown in Table 15. In the table, the concentration of the anticancer agent indicates the final concentration at the time of mixing the medical agent(s) and the anticancer agent degradation reaction equivalent concentration when setting the additive medical agent(s) at a target concentration.

TABLE 11

| | | Additive Medical Agent | Concentration Obtained From Standard Curve (%) | | | | Average Degradation Rate (%) |
|---|---|---|---|---|---|---|---|
| Sample | Anticancer Agent | Order of Addition | n1 | n2 | n3 | Average Value | (%) |
| | Cyclophosphamide | — | 100.7 | — | — | 100.7 | — |
| 1 | | First Agent | 12.9 | 14.1 | 13.0 | 13.4 | 86.6 |
| 2 | | Second Agent | 98.4 | 99.3 | 100.1 | 99.3 | 0.7 |
| 3 | | Third Agent | 100.5 | 94.2 | 95.1 | 96.6 | 3.4 |

TABLE 11-continued

| Sample | Anticancer Agent | Additive Medical Agent Order of Addition | Concentration Obtained From Standard Curve (%) n1 | n2 | n3 | Average Value | Average Degradation Rate (%) (%) |
|---|---|---|---|---|---|---|---|
| 4 | | First Agent → Second Agent | 96.7 | 93.8 | 99.7 | 96.7 | 3.3 |
| 5 | | First Agent → Third Agent | 10.8 | 13.7 | 10.6 | 11.7 | 88.3 |
| 6 | | First Agent → Second Agent → Third Agent | 95.6 | 96.6 | 97.1 | 96.5 | 3.5 |
| 7 | | Third Agent → First Agent → Second Agent | 88.6 | 98.4 | 92.4 | 93.1 | 6.9 |

TABLE 12

| Sample | Anticancer Agent | Additive Medical Agent Order of Addition | Concentration Obtained From Standard Curve (%) n1 | n2 | n3 | Average Value | Average Degradation Rate (%) (%) |
|---|---|---|---|---|---|---|---|
| | Epirubicin | — | 96.6 | — | — | 96.6 | — |
| 1 | | First Agent | 0 | 0 | 0 | 0 | 100 |
| 2 | | Second Agent | 128.2 | 127.2 | 126.7 | 127.4 | 0 |
| 3 | | Third Agent | 0 | 0 | 0 | 0 | 100 |
| 4 | | First Agent → Second Agent | 0 | 0 | 0 | 0 | 100 |
| 5 | | First Agent → Third Agent | 0 | 0 | 0 | 0 | 100 |
| 6 | | First Agent → Second Agent → Third Agent | 0 | 0 | 0 | 0 | 100 |
| 7 | | Third Agent → First Agent → Second Agent | 0 | 0 | 0 | 0 | 100 |

TABLE 13

| Sample | Anticancer Agent | Additive Medical Agent Order of Addition | Concentration Obtained From Standard Curve (%) n1 | n2 | n3 | Average Value | Average Degradation Rate (%) |
|---|---|---|---|---|---|---|---|
| | Cisplatin | — | 105.5 | — | — | 105.5 | — |
| 1 | | First Agent | 0 | 0 | 0 | 0 | 100 |
| 2 | | Second Agent | 16.5 | 21.4 | 24.1 | 20.7 | 79.3 |
| 3 | | Third Agent | 100.0 | 101.9 | 102.4 | 101.4 | 0 |
| 4 | | First Agent → Second Agent | 0 | 0 | 0 | 0 | 100 |
| 5 | | First Agent → Third Agent | 0 | 0 | 0 | 0 | 100 |
| 6 | | First Agent → Second Agent → Third Agent | 0 | 0 | 0 | 0 | 100 |
| 7 | | Third Agent → First Agent → Second Agent | 0 | 0 | 0 | 0 | 100 |

TABLE 14

| Sample | Anticancer Agent | Additive Medical Agent Order of Addition | Concentration Obtained From Standard Curve (%) n1 | n2 | n3 | Average Value | Average Degradation Rate (%) |
|---|---|---|---|---|---|---|---|
| | Carboplatin | — | 101.3 | — | — | 101.3 | — |
| 1 | | First Agent | 0 | 0 | 0 | 0 | 100 |
| 2 | | Second Agent | 58.4 | 54.8 | 53.5 | 55.5 | 44.5 |
| 3 | | Third Agent | 51.9 | 46.8 | 54.3 | 51.0 | 49.0 |
| 4 | | First Agent → Second Agent | 0 | 0 | 0 | 0 | 100 |
| 5 | | First Agent → Third Agent | 0 | 0 | 0 | 0 | 100 |

TABLE 14-continued

| Sample | Anticancer Agent | Additive Medical Agent Order of Addition | Concentration Obtained From Standard Curve (%) n1 | n2 | n3 | Average Value | Average Degradation Rate (%) |
|---|---|---|---|---|---|---|---|
| 6 | | First Agent → Second Agent → Third Agent | 0 | 0 | 0 | 0 | 100 |
| 7 | | Third Agent → First Agent → Second Agent | 0 | 0 | 0 | 0 | 100 |

TABLE 15

| Anticancer Agent | Concentration at Mixture (μg/mL) Final Concentration | Equivalent Concentration | Average Degradation Rate of Each Anticancer Agent after Mixture (%): Single Additive Medical Agent First Agent | Second Agent | Third Agent | Two Additive Medical Agents First Agent→ Second Agent | First Agent→ Third Agent | Three Additive Medical Agents First Agent→ Second Agent → Third Agent | Third Agent→ First Agent → Second Agent |
|---|---|---|---|---|---|---|---|---|---|
| Cyclophosphamide | 3.5 | 3.5 | 86.6 | 0.7 | 3.4 | 3.3 | 88.3 | 3.5 | 6.9 |
| Epirubicin | 3.5 | 3.5 | 100 | 0 | 100 | 100 | 100 | 100 | 100 |
| Cisplatin | 10 | 100 | 100 | 79.3 | 0 | 100 | 100 | 100 | 100 |
| Carboplatin | 20 | 200 | 100 | 44.5 | 49.0 | 100 | 100 | 100 | 100 |
| Fluorouracil | — | — | — | — | — | — | — | — | — |

From the results of Table 11, when a measurement sample was prepared for cyclophosphamide in accordance with the list of additive medical agents of Table 10, the cyclophosphamide content was decreased only in the first agent of Sample 1 and the sequential mixture of the first and third agents of Sample 5. On the other hand, in remaining Samples 2, 3, 4, 6, and 7, decrease in the cyclophosphamide content was not observed.

From the results of Table 12, when epirubicin was subjected to a similar operation, reduction in the epirubicin content was observed in Samples 1, 3, 4, 5, 6, and 7. On the other hand, the second agent alone of Sample 2 resulted in the content exceeding 100%. The cause of these results is not clear.

From the results of Table 13, when cisplatin was subjected to a similar operation, reduction in the cisplatin content was observed in Samples 1, 2, 4, 5, 6, and 7. On the other hand, the third agent alone of Sample 3, reduction in the cisplatin content was not observed.

From the results of Table 14, when carboplatin was subjected to a similar operation, reduction in the carboplatin content was observed in all of Samples 1, 2, 3, 4, 5, 6, and 7.

Comparing the chemical degradation performance of the anticancer agents from the results of Table 15, it was confirmed that, in the single additive medical agent mixture, the first agent (sodium hypochlorite aqueous solution) had the inactivation effect on all the anticancer agents. It was confirmed that the second agent (sodium thiosulfate aqueous solution) had the inactivation effect on cisplatin and carboplatin, but had little effect on epirubicin and cyclophosphamide. It was confirmed that the third agent (sodium hydroxide aqueous solution) had the inactivation effect on epirubicin and carboplatin, but had little effect on cyclophosphamide and cisplatin.

In the sequential mixture of two types of additive medical agents, unique results were brought about in the case of mixing cyclophosphamide and the first agent, then the second agent and the third agent. It is suggested that addition of the second agent serves to cancel the inactivation effect of the first agent, and addition of the third agent resulted in addition of their inactivation effects. For the anticancer agents except cyclophosphamide, the inactivation effect was exhibited in both the cases of adding the second agent and adding the third agent. This is considered because inactivation was complete at the initial mixture of the first agent.

In the sequential mixture of three types of additive medical agents, it is suggested that addition and mixing of the second agent serves to cancel the inactivation effect of the first agent both in the case of mixing the first agent to cyclophosphamide, then the second agent and then the third agent, and in the case of mixing the third agent, then the first agent and then the second agent. The whole degradation rate was greatly reduced.

From the above results, the first agent is most excellent in chemical degradation capability of the anticancer agents. In the case where the lapsed time after mixing is short, however, some anticancer agents, such as cyclophosphamide, cannot be degraded completely. As for the timing for adding the second agent after mixing each anticancer agent and the first agent, there is no problem in anticancer agents that are instantaneously degraded by mixture of the first agent (epirubicin, cisplatin, and carboplatin of the experimental examples), but when the second agent is added in the case where degradation is not completed by the first agent as described with reference to cyclophosphamide of the experimental example, the first agent produces a neutralization effect, which counteracts the inactivation effect. The anticancer agent thus remains as it is. On the other hand, as for the third agent, there was no effect that counteracted the inactivation effect of the first agent observed from the experimental example.

Experimental Example 4: Inspection of Medical Agent Concentration of First Agent

[1] Consideration

From the results of the above experimental examples, the leading role of the chemical degradation of each anticancer agent by medical agents lies in oxidation degradation by sodium hypochlorite as the first agent. In order to ascertain the proper concentration of sodium hypochlorite, several types of anticancer agents were used to recover and evaluate each anticancer agent after mixing each anticancer agent solution and the first agent solution varied in concentrations. Although the anticancer agent degradation capability cannot be determined unconditionally because it varies depending on the relative concentration with respect to medical agents, consideration is made assuming the anticancer agent concentration to be the concentration equivalent to the contamination level in the medical field (assumed to be about 1.0 $ng/cm^2$ at a high contamination level; the preparation area is approximately 3500 $cm^2$).

[2] Method

As the anticancer agent used as a specimen, cyclophosphamide (Shionogi & Co., Ltd.), Endoxan Lot 4248, an epirubicin raw drug (provided by Sicor Inc.), and a carboplatin raw drug (provided by Heraeus Holding GmbH) were prepared. The concentration of each anticancer agent was prepared so as to be the contamination-level equivalent concentration after mixing. The concentration of sodium hypochlorite as the first agent was prepared such that the concentration after mixing became 1%, 2%, 5%, and 10%, and additive sodium hydroxide was also prepared to be 1%. Each anticancer agent and the first medical agent were combined in accordance with the list of additive medical agents shown in Table 16. One medical agent was mixed while stirring for 10 seconds and left for 50 seconds, which means that each mixing interval was set at 60 seconds. The lapsed time up to the measurement after the final mixing was less than 2 minutes.

<Method for Measuring Cyclophosphamide>

The standard curve was obtained by a similar technique to the case of cyclophosphamide of Experimental Example 3. In accordance with the list of additive medical agents shown separately in Table 16, 1 mL of the anticancer agent concentrated solution was accurately weighed out, and each additive medical agent was added thereto. Then, water was added to be accurately adjusted to 10 mL, thereby obtaining a sample solution. A test was conducted on 95 μL of each of the sample solution and the solution for standard curve by liquid chromatography under the conditions of the test for cyclophosphamide of Experimental Example 3 to obtain the cyclophosphamide content from the equation of the standard curve.

<Method for Measuring Epirubicin>

The standard curve was obtained by a similar technique to the case of epirubicin of Experimental Example 3. In accordance with the list of additive medical agents shown in Table 16, 1 mL of the anticancer agent concentrated solution was accurately weighed out, and each additive medical agent was added thereto. Then, water was added to be accurately adjusted to 10 mL, thereby obtaining a sample solution. A test was conducted on 50 μL of each of the sample solution and the solution for standard curve, by liquid chromatography under the conditions of the test for epirubicin of Experimental Example 3 to obtain the epirubicin content from the equation of the standard curve.

<Method for Measuring Carboplatin>

The standard curve was obtained by a similar technique to the case of carboplatin of Experimental Example 3. In accordance with the list of additive medical agents shown in Table 16, 1 mL of the anticancer agent concentrated solution was accurately weighed out, and each additive medical agent was added thereto. Then, water was added to be accurately adjusted to 10 mL. Then, 1 mL of this solution was accurately weighed out, and acetonitrile was added to be adjusted to 10 mL, thereby obtaining a sample solution. A test was conducted on 20 μL of each of the sample solution and the solution for standard curve by liquid chromatography under the conditions of the test for carboplatin of Experimental Example 3 to obtain the carboplatin content from the equation of the standard curve.

TABLE 16

| | | Additive Agent | | |
|---|---|---|---|---|
| Sample | Anticancer Agent | Additive Concentration | Added Amount | Final Concentration |
| 1 | 1 mL of | — | 0 mL | 0% |
| 2 | Each | 2% | 5 mL | 1% |
| 3 | Anticancer | 10% | 2 mL | 2% |
| 4 | Agent | 10% | 5 mL | 5% |
| 5 | | 11% | 9 mL | 10% |

[3] Results

The results of degradation rate for each anticancer agent depending on the difference in concentration of the first agent are shown in Table 17. From these results, if the concentration of sodium hypochlorite as the first agent is more than or equal to 2% relative to each anticancer agent at a usual contamination level, it is considered useful for wiping of performing a wiping operation at intervals of 1 minute. As sodium hypochlorite has a higher concentration, a greater inactivation effect on each anticancer agent can be obtained, however, the stability of sodium hypochlorite and the safety in use need to be taken into consideration.

TABLE 17

| Anticancer Agent | | | Average Degradation Rate of Each Anticancer Agent after Mixture (%) | | | | |
|---|---|---|---|---|---|---|---|
| | Concentration at Mixture (μg/mL) | | Concentration of Sodium Hypochlorite as First Agent | | | | |
| Type | Final Concentration | Equivalent Concentration | 0% 0 g/L | 1% 10 g/L | 2% 20 g/L | 5% 50 g/L | 10% 100 g/L |
| Cyclophosphamide | 3.5 | 3.5 | 0 | — | 86.6 | 100 | 100 |
| Epirubicin | 3.5 | 3.5 | 0 | 100 | 100 | 100 | 100 |
| Carboplatin | 20 | 200 | 0 | 100 | 100 | 100 | 100 |

From the above results, it is considered that the optimum concentration of sodium hypochlorite concentration is 2% to 5%. As for the concentration of the second agent, which is intended to neutralize the first agent, 1 mol or more of sodium thiosulfate is added relative to 4 mol of sodium hypochlorite for the neutralization concentration. As for the concentration of the third agent, the degradation effect is observed for epirubicin and carboplatin, but there is little effect on cyclophosphamide, from the results of Experimental Examples 2 and 3. The concentration of the third agent used for this experiment is 0.8 mol/L, which is assumed as the maximum concentration. The minimum concentration is considered to fall within a practical use range up to the concentration of 0.03 mol/L used in a recovery test.

Based on these results, in the next wipe wiping inspection, 14 mL of each of the first, second and third agents was added to a wipe. The sodium hypochlorite concentration as the first agent was set at the specification least concentration of 2%. The second agent was set at the upper limit concentration of 0.27 mol/L which is the amount of neutralization for the maximum concentration of the first agent. The third agent was set at the upper limit concentration of 0.8 mol/L. Then, an inspection of wiping of cyclophosphamide is conducted.

Experimental Example 5: Wipe Wiping Test

[1] End-Points

In order to compare wipe performance of medical-agent-impregnated wipes, cyclophosphamide was recovered from above an indicated area of a working table contaminated by cyclophosphamide using a dedicate kit for anticancer agent contamination evaluation just after 1) performing a wiping operation up to the last step using the wipe set of each of the example and comparative example, 2) a wiping operation in which the order of wiping with the wipe set is varied (the example only), and 3) performing a wiping operation up to a wiping step by the wipe set of the example and the comparative example. A quantitative analysis was conducted for cyclophosphamide in a specialized institute, thereby confirming the wipe wiping effect.

[2] Setup of Contaminated Area

In carrying out a wiping test, all the operations were performed in a safety cabinet with reference to the anticancer medical agent preparation manual, the administrative procedure for using hazard medicines of handling guideline, and the like. The operations were conducted in compliance with wearing of double gloves for avoiding a contamination in a system and an operation method with them, and while wearing a mask, glasses, a coat, and shoes for safe operation. In a safety cabinet (SCV-1300E Class II-B provided by Hitachi Appliances, Inc.), a wiped area assuming the central part of an area of 190 cm in breadth and 52 cm in depth as a preparation area was marked by a tape. A sealed anticancer agent solution was placed in a right-hand side area and a waste pack was placed in a left-hand side area, and care was taken such that the flows of operation do not overlap to cause contamination.

As a target anticancer agent, cyclophosphamide (100 mg of Endoxan for injection provided by Shionogi & Co., Ltd., production number: 4248) was used. Normal saline was added to 100 mg of a cyclophosphamide raw drug to be adjusted to 10 mL. After dissolution, 1 mL of this solution was accurately weighed out, and normal saline was added to be adjusted to 100 mL, thereby obtaining a high-level drop solution (100 ppm). Next, 10 mL of this solution was accurately weighed out, and normal saline was added to be adjusted to 20 mL, thereby obtaining an intermediate-level drop solution (50 ppm). Furthermore, 5 mL of a 100 ppm solution was accurately weighed out, and normal saline was added to be adjusted to 50 mL, thereby obtaining a low-level drop solution (10 ppm).

Figure 3:
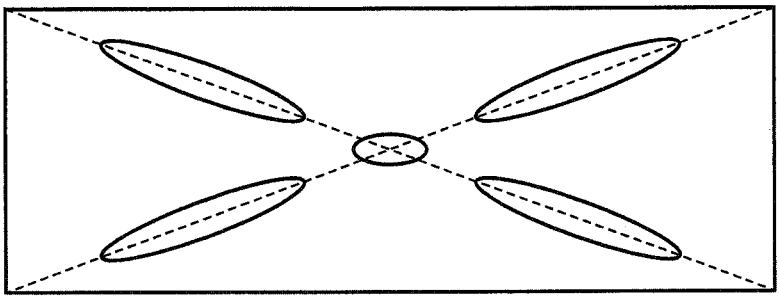
FIG. 3 is a drawing schematically showing drop positions in marking areas when dropping a sample in which cyclophosphamide is used for contamination in an experimental example.

As for the contamination level using the prepared drop solutions, the amount of cyclophosphamide per wiped area was set such that the concentration per unit area became 0.1 ng/cm$^2$ at the low level, 0.5 ng/cm$^2$ at the intermediate level, and 1.0 ng/cm$^2$ at the high level (see Table 18). The amount of a drop was set at 1 μL. As schematically shown in FIG. 3, the solution was dropped with a pipette onto four elliptical regions on the diagonal lines in the marked area and a region at the central part including a point at which the diagonal lines intersect in a distributed manner in accordance with Table 18. The wiped area was set at two types of 3500 cm$^2$ (=87.5 cm×40 cm) and 1860 cm$^2$ (=46.5 cm×40 cm).

TABLE 18

| | | | Wiped Area | | | | | |
|---|---|---|---|---|---|---|---|---|
| | | | 3500 $cm^2$ | | | 1860 $cm^2$ | | |
| | | | Concentration of Cyclo-phosphamide | The Number of Drops of 1 μm | Total Weight of Cyclophosphamide | Concentration of Cyclophosphamide | The Number of Drops of 1 μm | Total Weight of Cyclophosphamide |
| Contamination Level | Low Level | 0.1 $ng/cm^2$ | 10 ppm | 35 | 350 ng | 10 ppm | 19 | 190 ng |
| | Intermediate Level | 0.5 $ng/cm^2$ | 50 ppm | 35 | 1750 ng | 50 ppm | 19 | 950 ng |
| | High Level | 1.0 $ng/cm^2$ | 100 ppm | 35 | 3500 ng | 100 ppm | 19 | 1900 ng |

[3] Preparation of Wipe Sets of Example and Comparative Example and Description of Wiping Operation A wipe set (Example) of three steps including a wipe impregnated with a sodium hypochlorite aqueous solution as the first wipe, a wipe impregnated with a sodium hydroxide aqueous solution as the second wipe, and a wipe impregnated with a sodium thiosulfate aqueous solution as the third wipe was prepared. For each wipe, a 100% polypropylene nonwoven fabric having a size of 23 cm×23 cm and a thickness of 0.3 mm (33300 SERIES WIPES/100% melt blown polypropylene 33309 wipe (provided by MAX-CLEAN Corporation) was used as the substrate. Impregnation was conducted such that the first wipe contained 68 mg of sodium hypochlorite per gram of the wipe, the second wipe contained 92 mg of sodium thiosulfate per gram of the wipe, and the third wipe contained 109 mg of sodium hydroxide per gram of the wipe.

At the time of wiping, each wipe was folded into four (11 cm×11 cm) and an indicated area was wiped uniformly. Then, the wipe was reversed, and the area was wiped again with a clean quarto surface. Then wiping was performed three times with clean quarto surfaces (handling was made such that a clean surface was always in contact with the wiped surface and gloves). First, wiping with the first wipe was performed, and the surface was left for 1 minute. Then, wiping with the second wipe was performed, and the surface was left similarly for 1 minute. Then, wiping with the third wipe was performed.

As the wipe set of Comparative Example, a two-step kit (product name: Surface Safe (registered trademark) produced by Hospira, Inc., product number: Lot 10F03) formed of a wipe impregnated with a sodium hypochlorite aqueous solution (corresponding to the first wipe) and a wipe impregnated with a sodium thiosulfate aqueous solution (corresponding to the second wipe) was used. According to the recommendation by the manufacturer, the wiped area with the kit is specified as less than 1860 $cm^2$, evaluation was made only for the area of 1860 $cm^2$. Each wipe of the kit was made of a nonwoven fabric having a size of 14 cm×28 cm and a thickness of 0.15 mm and was stored in a package in a small size folded into 32 (3.5 cm×3.5 cm). In the wiping operation, each wipe at the time of open was extended to the state folded into four and the wiped surface was wiped. Wiping was repeated three times in a manner that a clean surface was always in contact with the wiped surface and the gloves similarly to the wipe set of the Example. First, wiping was performed with the wipe impregnated with a sodium hypochlorite aqueous solution, and the surface was left for 1 minute. Then wiping was performed with the wipe impregnated with a sodium thiosulfate aqueous solution.

[4] Cleaning Operation

In the wiping test, an intentional contamination and a wiping operation are performed repeatedly in the same area. Therefore, a cleaning operation (wiping method for recovery up to the clean level which does not interfere with the test) needs to be established. Thus, a preliminary test was conducted by a sampling method described in [5] to determine a cleaning technique. For this evaluation, intentional contaminations at a low level of 50 ng and a high level of 5000 ng were given on a 2800 $cm^2$ area with 1 μL of a dropping solution of cyclophosphamide. The area was left for 10 minutes for drying liquid droplets, and then positive control for each contamination level and the wiping operation by a different number of times (in which dilution by water spraying and industrial oversized wipes were used). Thereafter, extraction and quantification of each sample were performed using the sampling kit. Sampling was conducted at the n1 level in series for the cases of positive control at each contamination level, three times of wiping, four times of wiping, five times of wiping, and ten times of wiping. Subsequently, sampling was conducted at the n2 level and the n3 level. The lower limit of quantitative analysis of cyclophosphamide is 10 ng. The results are shown in Table 19.

TABLE 19

| Contamination Level | The Number of Times of Wiping | Amount of Drop of Cyclophosphamide (ng) | Detected Amount of Cyclophosphamide (ng) | | | |
|---|---|---|---|---|---|---|
| | | | n1 | n2 | n3 | average |
| Low Level | Positive Control | 49.6 | 44 | 45 | 38 | 42 |
| | 3 | | <10 | <10 | <10 | <10 |
| | 4 | | 490 | <10 | <10 | 170 |
| | 5 | | 43 | <10 | <10 | 21 |
| | 10 | | 15 | <10 | <10 | 12 |

TABLE 19-continued

| Contamination Level | The Number of Times of Wiping | Amount of Drop of Cyclophosphamide (ng) | Detected Amount of Cyclophosphamide (ng) n1 | n2 | n3 | average |
|---|---|---|---|---|---|---|
| High Level | Positive Control | 4960 | 4400 | 3900 | 3400 | 3900 |
| | 3 | | 14 | <10 | <10 | 11 |
| | 4 | | 11 | <10 | <10 | 10 |
| | 5 | | <10 | <10 | <10 | <10 |
| | 10 | | <10 | <10 | <10 | <10 |

As a result, abnormal values appeared only at n1. However, from the fact that the possibility of contamination due to a misoperation was high at n1 and that the cleaning effect was clearly brought about in the results at the n2 and n3 levels in which the operation had been corrected, it was determined that performing this operation three times is favorable for cleaning that would cause any trouble in a main test. From the above results, each time sampling was terminated in the wiping test, this cleaning was performed and sequential sampling was performed.

that processing including preparation of a cyclophosphamide solution and sampling was completed in a single work day. An operator A handled all the 75 specimens on the first day and the last day of a four-day operation, and an operator B handled the specimens for two intermediate days.

[6] Results

The results of the area test on a 3500 $cm^2$ wiping area (cyclophosphamide quantitative analysis lower limit: 10 ng) are shown in Table 20.

TABLE 20

| Contamination Creation and Wiping Operation: Sample | Contamination Level | Wiped Area | Wipe Set Used | Order of Wiping | Amount of Drop of Cyclophosphamide (ng) | Detected Amount of Cyclophosphamide (ng) n1 | n2 | n3 | Average Value | Cyclophosphamide Detection (%) |
|---|---|---|---|---|---|---|---|---|---|---|
| 1 | Low Level | 3500 $cm^2$ | — | Positive Control | 349 | 280 | 410 | 330 | 340 | 97.4 |
| 2 | 0.1 $ng/cm^2$ | | Example | First → Second → Third | | <10 | <10 | <10 | <10 | 0 |
| 3 | | | Example | Third → First → Second | | <10 | <10 | <10 | <10 | 0 |
| 4 | | | Example | First → Third → Second | | <10 | <10 | <10 | <10 | 0 |
| 5 | Intermediate | | — | Positive Control | 1745 | 1500 | 1300 | 1700 | 1500 | 86.0 |
| 6 | Level | | Example | First → Second → Third | | <10 | <10 | <10 | <10 | 0 |
| 7 | 0.5 $ng/cm^2$ | | Example | Third → First → Second | | <10 | <10 | <10 | <10 | 0 |
| 8 | | | Example | First → Third→ Second | | <10 | <10 | <10 | <10 | 0 |
| 9 | High Level | | — | Positive Control | 3490 | 2500 | 2600 | 2900 | 2667 | 76.4 |
| 10 | 1.0 $ng/cm^2$ | | Example | First → Second → Third | | <10 | <10 | <10 | <10 | 0 |
| 11 | | | Example | Third → First → Second | | <10 | <10 | <10 | <10 | 0 |
| 12 | | | Example | First → Third → Second | | <10 | <10 | <10 | <10 | 0 |
| 13 | | | Example | First | | 140 | 69 | 81 | 97 | 2.8 |
| 14 | | | Example | Second | | 490 | 310 | 150 | 317 | 11.0 |
| 15 | | | Example | Third | | 67 | 120 | 82 | 90 | 2.6 |
| 16 | | | Example | First → Second | | 14 | 37 | 22 | 24 | 0.7 |
| 17 | | | Example | Third → First | | <10 | 10 | 11 | 10 | 0.3 |
| 18 | | | Example | First → Third | | <10 | 15 | <10 | 12 | 0.3 |

[5] Sampling Method

Recovery of a residue on the wiped surface in a preliminary test (confirmation of a cleaning operation) and a main test (Example and Comparative Example) was performed using a dedicated kit for recovery and analysis of anticancer agent contamination. With this kit, 0.03 N sodium hydroxide was sprayed onto a target area, the whole area was wiped with a wipe made of pulp so as to recover the solution. This operation was repeated three times. The wipe was recovered in an exclusive bottle, and a cyclophosphamide residue was recovered. A specimen sampling bottle was kept in a freezer at less than or equal to −20° C. (MPR-411F provided by SANYO Electric Co., Ltd.), conveyed in a dry ice pack, subjected to extraction filtration in a specialized institute and to quantitative analysis by LC/MS/MS (provision of the kit and analysis were entrusted to KOBELCO Research Institute).

Specimen sampling of each single level (Samples 1 to 18 and Samples 19 to 25) at the n3 level was conducted such In the area test on the 3500 $cm^2$ wiping area, the average recovery rate at each concentration of positive control was 97.4% at the low contamination level, 86.0% at the intermediate level, and 76.4% at the high level. As the level became higher, the recovery rate was degraded similarly to the preliminary test. The result of three-step wiping with the wipe set of the Example was below the detection limit at each of the low level, the intermediate level and the high level of contamination level. As for the order of usage, a significant difference cannot be determined among the case of using the first, second and third wipes in this order, the case of using the third, first and second wipes in this order, and the case of using the first, third and second wipes in this order, because all the results were below the detection limit (it is noted that, the second wipe is excluded from the first order of usage because it is intended to neutralize the first wipe and will not be used before the first wipe). The removal rate in the case of not using all of three types of wipes in the wipe set of the Example at a high contamination level was 97% both in the cases of using one type of wipe, that is, in the case of using the first wipe alone (Sample 13) and in the case of using the third wipe alone (Sample 15), and a significant difference was not observed, while in the case of using the second wipe alone, the rate was reduced to 89%. When two types of wipes were used, the removal rate in the case of using the second wipe after the first wipe (Sample 16) was 99.3%, and the removal rate in the case of using the first wipe after the third wipe (Sample 17) was 99.7%, and the removal rate in the case of using the third wipe after the first wipe (Sample 18) was 99.7%. Thus, there is no significant difference therebetween.

The results of the area test on the 1860 $cm^2$ wiping area (cyclophosphamide quantitative analysis lower limit: 10 ng) is shown in Table 21.

TABLE 21

| Contamination Creation and Wiping Operation | | | | | Amount of Drop of | Detected Amount of Cyclophosphamide (ng) | | | | Cyclo- |
|---|---|---|---|---|---|---|---|---|---|---|
| Sample | Contamination Level | Wiped Area | Wipe Set Used | Order of Wiping | Cyclophosphamide (ng) | n1 | n2 | n3 | Average Value | phosphamide Detection (%) |
| 19 | Low Level 0.1 ng/$cm^2$ | 1860 $cm^2$ | Comparative Example | First → Second | 190 | <10 | <10 | <10 | <10 | 0 |
| 20 | | | Example | First → Second → Third | | <10 | <10 | <10 | <10 | 0 |
| 21 | Intermediate Level | | Comparative Example | First → Second | 950 | 16 | 18 | 16 | 17 | 1.8 |
| 22 | 0.5 ng/$cm^2$ | | Example | First → Second → Third | | <10 | <10 | <10 | <10 | 0 |
| 23 | High Level 1.0 ng/$cm^2$ | | Comparative Example | First → Second | 1900 | 40 | 26 | 39 | 35 | 1.8 |
| 24 | | | Example | First → Second → Third | | <10 | <10 | <10 | <10 | 0 |
| 25 | | | Comparative Example | First | | 130 | 100 | 140 | 123 | 6.5 |

In the area test on the 1860 $cm^2$ wiping area, the wipe set of the example and the wipe set of the comparative example are compared in removal rate. In the wipe set of the comparative example, the removal rate varied depending on the contamination level, and a cyclophosphamide residue was detected when the contamination level was at the intermediate level and at the high level (the removal rate at the low level=100% and the removal rate at the intermediate/high level=98.2%). On the other hand, with the wipe set of the example, the rate was all 100% (below the detection limit) when the contamination level was at the low level, the intermediate level and the high level. In the wipe set of the comparative example, the removal rate in the case of using the first wipe alone in the wipe set of the comparative example (Sample 25) was 93.5%, at which a substantial amount of cyclophosphamide residue was observed.

The average residual amount (ng) and removal rate (%) of cyclophosphamide with the wipe set of the example (wiped area: 3500 $cm^2$) and the wipe set of the comparative example (wiped area: 1860 $cm^2$) at all the contamination levels of the low level, the intermediate level and the high level are shown in Table 22. As for the wipe set of the example (wiped area: 3500 $cm^2$) and the wipe set of the comparative example (wiped area: 1860 $cm^2$), the average residual amount (ng) and removal rate (%) of cyclophosphamide at the contamination level of high level, after the first step, the second step and the third step (wipe of the example only) in the wiping steps with the wipe kit are shown in Table 23.

TABLE 22

| Wipe Set Used | Example | | Comparative Example | |
|---|---|---|---|---|
| Wiped Area | 3500 $cm^2$ | | 1860 $cm^2$ | |
| Amount of Contamination | 3490 ng | | 1900 ng | |
| | Residual Amount, Removal Rate | | | |
| | Residual Amount (ng) | Removal Rate | Residual Amount (ng) | Removal Rate |
| Low Level (0.1 ng/$cm^2$) | <10 | 100% | <10 | 100% |
| Intermediate Level (0.5 ng/$cm^2$) | <10 | 100% | 17 | 98.2% |
| High Level (1.0 ng/$cm^2$) | <10 | 100% | 35 | 98.2% |

TABLE 23

| Wipe Set Used | Example | | Comparative Example | |
|---|---|---|---|---|
| Wiped Area | 3500 $cm^2$ | | 1860 $cm^2$ | |
| Amount of Contamination | 3490 ng | | 1900 ng | |
| | Residual Amount, Removal Rate | | | |
| | Residual Amount (ng) | Removal Rate | Residual Amount (ng) | Removal Rate |
| First Wiping Step | 93 | 97.3% | 123 | 93.5% |
| Second Wiping Step | 17 | 99.5% | 35 | 98.2% |
| Third Wiping Step | <10 | 100% | — | — |

The results shown in Tables 22 and 23 revealed that the wipe set of the example was effective in cleaning at any contamination level of the low, intermediate and high levels in the set-up wiped area of 3500 $cm^2$. It is also revealed that the wipe set of the example was useful for complete removal at the high contamination level of the 3500 $cm^2$ wiped are. On the other hand, in the wipe set of the comparative example, remaining cyclophosphamide was detected in the test for high level contamination irrespective of 1860 $cm^2$ which is one half of the wiped area with the wipe set of the example. Although a simple comparison cannot be made between the example and the comparative example because they differ in evaluation area (=the amount of drop of cyclophosphamide), it has been found that a residue arises with a two-step wiping operation.

The cause of these differences is easy to understand by comparing the chemical degradation capability of the additive medical agent shown in Table 15 relative to cyclophosphamide and the removal rate (%) of cyclophosphamide between the wiping steps with the wipe set of the example shown in Table 23. The comparison between the chemical degradation capability with respect to cyclophosphamide and wipe removal capability are tabulated in Table 24.

TABLE 24

| Chemical Degradation of Cyclophosphamide | | | Wiping Removal Rate of Cyclophosphamide | | |
|---|---|---|---|---|---|
| Concentration of Anticancer Agent | 3500 ng/mL | | Concentration of Anticancer Agent | 3500 ng | |
| Mixing Interval | 1 min | | Wiping Interval | 1 min | |
| Evaluation Time | 3-5 min | | Evaluation Time | 3-5 min | |
| Mixed Medical Agent | Order of Mixture | Degradation Rate (%) | Wiping Operation | Order of Wiping | Removal Rate (%) |
| Addition of Single Agent | First | 86.6 | 1 Step | First | 97.2 |
| | Second | 0.7 | | Second | 89.0 |
| | Third | 3.4 | | Third | 97.4 |
| Addition of Two Agents | First → Second | 3.3 | 2 Steps | First → Second | 99.3 |
| | Third → First | — | | Third → First | 99.7 |
| | First → Third | 88.3 | | First → Third | 99.7 |
| Addition of Three Agents | First → Second → Third | 3.5 | 3 Steps | First → Second → Third | 100 |
| | Third → First → Second | 6.9 | | Third → First → Second | 100 |
| | First → Third → Second | — | | First → Third → Second | 100 |

In these tests, the relative concentration (3500 ng) of cyclophosphamide with respect to the additive medical agent concentration, the mixing interval (wiping interval), and the lapsed time up to the measurement are substantially the same, and cyclophosphamide is selected as an anticancer agent that cannot be completely degraded in a short time. Comparing the single-agent mixture in the chemical test and the first step of the wiping test, the chemical degradation capability of cyclophosphamide and the first agent is 86.6%, while the wiping removal rate of the first wipe is 97.2%. The chemical degradation capability of cyclophosphamide and the third agent is 3.3%, while the wiping removal rate of the third wipe is 97.4%. It is suggested that the third agent is inferior to the first agent in chemical degradation capability, but has wiping removal capability comparable to that of the first wipe. On the other hand, the wiping removal capability of the second wipe in which the second agent was used was only 89.0%, which is lower than that of the third wipe. Next, comparing the sequential mixture of the first agent and the second agent in the chemical test with the second step in the wiping test (wiping operation with the first wipe and the second wipe), the chemical degradation capability is reduced to 3.3% due to the neutralizing effect in the case of adding the first agent and then the second agent. On the other hand, the wipe wiping removal rate is 99.3%. This is considered because physical removal is functioning in the wipe in addition to the chemical degradation effect. However, in the residue of the anticancer agent not captured into the wipe and left on the wiped surface, addition of the second agent counteracts the anticancer-agent inactivation effect of the first agent, so that cyclophosphamide remains. Comparing the sequential mixture of the first, second and third agents in the chemical test with the third step in the wiping test (wiping operation with the first, second and third wipes), physical removal is completed in the wipe operation, while the chemical degradation can bring about only slight degradation (this is because addition of the second agent counteracted the inactivation effect of the first agent). It is considered that the phenomenon of the sequential mixture in these chemical tests is caused mainly by the anticancer agent left on the wiped surface and the medical agents coming out of the wipes.

From the above results, the two-step kit in which the first and second agents are used is satisfactory for removing an anticancer agent that is degraded instantaneously by the first agent, but will cause insufficient removal only with the chemical degradation capability in the case of an anticancer agent that cannot be degraded in a short time. Because there are variable factors of the type of anticancer agent, relative concentration and operating time in an actual contamination situation or a cleaning operation, it must be recognized that anticancer agent degradation by the first agent may be incomplete in some cases. Although instances of setting the concentration at 40% in order to improve the degradation performance of the first agent are introduced, it is predicted that not only they bring danger in use, but problems arise in maintenance of concentration and durability as a wipe. In order to compensate for these problems, the present invention has an object to devise a wipe set in which a residue on a wiped surface is reduced and re-contamination is avoided by three steps of the first agent and the second agent followed by the third agent improved in the physical removal capability and by using a wipe substrate in which absorbability and thickness are considered, so that the chemical degradation capability and the physical removal capability can be exerted to the utmost, and an anticancer agent can be removed from a contaminated area effectively and safely in a short time. Wiping removal can be effectively conducted by the wiping operation of three steps by any of the first, second and third methods of the order of wiping with this wipe set. In particular, in the method of first using the first wipe, even if a large amount of an anticancer agent absorbed into the first wipe has not been degraded in the wiping operation (in a short time interval), the anticancer agent makes a continuous reaction with the first agent in waste, so that reduction in contamination concentration of waste can be expected, which is considered as a favorable method.

REFERENCE SIGNS LIST

1, 2 sheet; 3 sealed part; 4 push-out-side storage portion; 5 introduced-side storage portion; 6 barrier sealed part; 7 connection sealed part; 8 recess; 9 projection.

The invention claimed is:

1. A wiping method in which a wipe set is used for wiping away an anticancer agent on a cleaning surface, wherein the anticancer agent is selected from the group consisting of cisplatin, carboplatin, epirubicin and cyclophosphamide, the wiping method comprising the steps of:

wiping with a first wipe that is impregnated with 65 to 170 mg of a sodium hypochlorite aqueous solution per gram of the first wipe for denaturing the anticancer agent to reduce or eliminate a medicinal effect of the anticancer agent, wherein the anticancer agent is degraded by wiping with the first wipe when the anticancer agent is cisplatin, carboplatin or epirubicin;

after wiping with the first wipe, wiping, with a second wipe that is impregnated with 35 to 92 mg of a sodium thiosulfate aqueous solution per gram of the second wipe, a trace of wiping with the first wipe, for degrading the anticancer agent, wherein the anticancer agent remaining on the cleaning surface is degraded by wiping with the second wipe when the anticancer agent is cisplatin or carboplatin; and after wiping with the second wipe, wiping, with a third wipe that is impregnated with 4 to 110 mg of a sodium hydroxide aqueous solution per gram of the third wipe for floating and removing the anticancer agent, and for degrading the anticancer agent, wherein the anticancer agent remaining on the cleaning surface is degraded by wiping with the third wipe when the anticancer agent is epirubicin, wherein said first wipe further contains 8.5 to 34 mg of sodium hydroxide per gram of the first wipe, and chlorine concentration of sodium hypochlorite in said first wipe is maintained by said sodium hydroxide, wherein each of the first, second and third wipes includes a wipe substrate, and the wipe substrate is a nonwoven fabric made of 100% polypropylene, and wherein the first wipe is packed in a first packing material configured such that the wipe substrate, the sodium hypochlorite aqueous solution and the sodium hydroxide aqueous solution are stored, and the first packing material is a bag-type article in which polyethylene/aluminum/polyethylene layers are stacked in an order from an outer side of the first packing material to an inner side of the first packing material, the second wipe is packed in a second packing material configured such that the wipe substrate and the sodium thiosulfate aqueous solution are stored, and the second packing material is a bag-type article in which polyethylene/aluminum/polyethylene layers are stacked in an order from an outer side of the second packing material to an inner side of the second packing material, the third wipe is packed in a third packing material configured such that the wipe substrate and the sodium hydroxide aqueous solution are stored, and the third packing material is a bag-type article in which polyethylene/aluminum/polyethylene layers are stacked in an order from an outer side of the third packing material to an inner side of the third packing material, and wherein an area of each of the first, second and third wipes falls within a range of 525 to 930 $cm^2$ for wiping of an area of about 3500 $cm^2$, which is the smallest space used for preparation of the anticancer agent, and a thickness of each of the first, second and third wipes is in a range of 0.2 to 0.5 mm.

2. The method according to claim 1, wherein an interval of at least 60 seconds is set between the respective steps.

3. A wipe set for used in the method of claim 1, comprising:

the first wipe impregnated with 65 to 170 mg of a sodium hypochlorite aqueous solution per gram of the first wipe;

the second wipe impregnated with 35 to 92 mg of a sodium thiosulfate aqueous solution per gram of the second wipe; and the third wipe impregnated with 4 to 110 mg of a sodium hydroxide aqueous solution per gram of the third wipe, wherein said first wipe further contains 8.5 to 34 mg of sodium hydroxide per gram of the first wipe, and chlorine concentration of sodium hypochlorite in said first wipe is maintained by said sodium hydroxide, wherein each of the first, second and third wipes includes a wipe substrate, and the wipe substrate is a nonwoven fabric made of 100% polypropylene, and wherein the first wipe is packed in the first packing material configured such that the wipe substrate, the sodium hypochlorite aqueous solution and the sodium hydroxide aqueous solution are stored, and the first packing material is the bag-type article in which polyethylene/aluminum/polyethylene layers are stacked in the order from the outer side of the first packing material to the inner side of the first packing material, the second wipe is packed in the second packing material configured such that the wipe substrate and the sodium thiosulfate aqueous solution are stored, and the second packing material is the bag-type article in which polyethylene/aluminum/polyethylene layers are stacked in the order from the outer side of the second packing material to the inner side of the second packing material, and the third wipe is packed in the third packing material configured such that the wipe substrate and the sodium hydroxide aqueous solution are stored, and the third packing material is the bag-type article in which polyethylene/aluminum/polyethylene layers are stacked in the order from the outer side of the third packing material to the inner side of the third packing material.

4. The method according to claim 1, wherein each of the first, second and third packing materials includes two storage portions each being capable of storing a filling, and a barrier sealed part which is peelable by pressing one of the storage portions is formed between the two storage portions.

5. The method according to claim 1, wherein a thickness of each of the first, second and third wipes falls within a range of 0.2 to 0.3 mm.

6. A wiping method in which a wipe set is used for wiping away an anticancer agent on a cleaning surface, wherein the anticancer agent is selected from the group consisting of cisplatin, carboplatin, epirubicin and cyclophosphamide, the wiping method, comprising the steps of:

wiping with a first wipe that is impregnated with 4 to 110 mg of a sodium hydroxide aqueous solution per gram of the first wipe for physically removing at least part of the anticancer agent, wherein the anticancer agent is degraded by wiping with the first wipe when the anticancer agent is epirubicin;

after wiping with the first wipe, wiping, with a second wipe that is impregnated with 65 to 170 mg of a sodium hypochlorite aqueous solution per gram of the second wipe, for reducing a concentration of the anticancer agent left on the wiped surface, and degrading the anticancer agent, wherein the anticancer agent is degraded by wiping with the second wipe when the anticancer agent is cisplatin, carboplatin or epirubicin; and after wiping with the second wipe, wiping, with a third wipe that is impregnated with 35 to 92 mg of a sodium thiosulfate aqueous solution per gram of the third wipe, a trace of wiping with the second wipe, for neutralizing a residue after wiping with the second wipe, wherein the anticancer agent remaining on the cleaning surface is degraded by wiping with the third wipe when the anticancer agent is cisplatin or carboplatin, wherein said second wipe further contains 8.5 to 34 mg of sodium hydroxide per gram of the second wipe, and chlorine concentration of sodium hypochlorite in said second wipe is maintained by said sodium hydroxide, wherein each of the first, second and third wipes includes a wipe substrate, and the wipe substrate is a nonwoven fabric made of 100% polypropylene, and wherein the first wipe is packed in a first packing material configured such that the wipe substrate and the sodium hydroxide aqueous solution are stored, and the first packing material is a bag-type article in which polyethylene/aluminum/polyethylene layers are stacked in an order from an outer side of the first packing material to an inner side of the first packing material, the second wipe is packed in a second packing material configured such that the wipe substrate, the sodium hypochlorite aqueous solution and the sodium hydroxide aqueous solution are stored, and the second packing material is a bag-type article in which polyethylene/aluminum/polyethylene layers are stacked in an order from an outer side of the second packing material to an inner side of the second packing material, the third wipe is packed in a third packing material configured such that the wipe substrate and the sodium thiosulfate aqueous solution are stored, and the third packing material is a bag-type article in which polyethylene/aluminum/polyethylene layers are stacked in an order from an outer side of the third packing material to an inner side of the third packing material, and wherein an area of each of the first, second and third wipes falls within a range of 525 to 930 $cm^2$ for wiping of an area of about 3500 $cm^2$, which is the smallest space used for preparation of the anticancer agent, and a thickness of each of the first, second and third wipes is in a range of 0.2 to 0.5 mm.

7. The method according to claim 6, wherein an interval of at least 60 seconds is set between the respective steps.

8. A wipe set for used in the method of claim 6, comprising:

the first wipe impregnated with 4 to 110 mg of a sodium hydroxide aqueous solution per gram of the first wipe;

the second wipe impregnated with 65 to 170 mg of a sodium hypochlorite aqueous solution per gram of the second wipe; and the third wipe impregnated with 35 to 92 mg of a sodium thiosulfate aqueous solution per gram of the third wipe, wherein said second wipe further contains 8.5 to 34 mg of sodium hydroxide per gram of the second wipe, and chlorine concentration of sodium hypochlorite in said second wipe is maintained by said sodium hydroxide, wherein each of the first, second and third wipes includes a wipe substrate, and the wipe substrate is a nonwoven fabric made of 100% polypropylene, and wherein the first wipe is packed in the first packing material configured such that the wipe substrate and the sodium hydroxide aqueous solution are stored, and the first packing material is the bag-type article in which polyethylene/aluminum/polyethylene layers are stacked in the order from the outer side of the first packing material to the inner side of the first packing material, the second wipe is packed in the second packing material configured such that the wipe substrate, the sodium hypochlorite aqueous solution and the sodium hydroxide aqueous solution are stored, and the second packing material is the bag-type article in which polyethylene/aluminum/polyethylene layers are stacked in the order from the outer side of the second packing material to the inner side of the second packing material, and the third wipe is packed in the third packing material configured such that the wipe substrate and the sodium thiosulfate aqueous solution are stored, and the third packing material is the bag-type article in which polyethylene/aluminum/polyethylene layers are stacked in the order from the outer side of the third packing material to the inner side of the third packing material.

9. The method according to claim 6, wherein each of the first, second and third packing materials includes two storage portions each being capable of storing a filling, and a barrier sealed part which is peelable by pressing one of the storage portions is formed between the two storage portions.

10. The method according to claim 6, wherein a thickness of each of the first, second and third wipes falls within a range of 0.2 to 0.3 mm.

11. A wiping method in which the wipe set is used for wiping away an anticancer agent on a cleaning surface, wherein the anticancer agent is selected from the group consisting of cisplatin, carboplatin, epirubicin and cyclophosphamide, the wiping method comprising the steps of:

wiping with a first wipe that is impregnated with 65 to 170 mg of a sodium hypochlorite aqueous solution per gram of the first wipe for denaturing the anticancer agent to reduce or eliminate a medicinal effect of the anticancer agent, wherein the anticancer agent is degraded by wiping with the first wipe when the anticancer agent is cisplatin, carboplatin or epirubicin;

after wiping with the first wipe, wiping, with a second wipe that is impregnated with 4 to 110 mg of a sodium hydroxide aqueous solution per gram of the second wipe, for floating and removing the anticancer agent, and for degrading the anticancer agent, wherein the anticancer agent remaining on the cleaning surface is degraded by wiping with the second wipe when the anticancer agent is epirubicin; and after wiping with the second wipe, wiping, with a third wipe that is impregnated with 35 to 92 mg of a sodium thiosulfate aqueous solution per gram of the third wipe, a trace of wiping with the first wipe, for neutralizing a residue after wiping with the first wipe, wherein the anticancer agent remaining on the cleaning surface is degraded by wiping with the third wipe when the anticancer agent is cisplatin or carboplatin, wherein said first wipe further contains 8.5 to 34 mg of sodium hydroxide per gram of the first wipe, and chlorine concentration of sodium hypochlorite in said first wipe is maintained by said sodium hydroxide, wherein each of the first, second and third wipes includes a wipe substrate, and the wipe substrate is a nonwoven fabric made of 100% polypropylene, and wherein the first wipe is packed in a first packing material configured such that the wipe substrate, the sodium hypochlorite aqueous solution and the sodium hydroxide aqueous solution are stored, and the first packing material is a bag-type article in which polyethylene/aluminum/polyethylene layers are stacked in an order from an outer side of the first packing material to an inner side of the first packing material, the second wipe is packed in a second packing material configured such that the wipe substrate and the sodium hydroxide aqueous solution are stored, and the second packing material is a bag-type article in which polyethylene/aluminum/polyethylene layers are stacked in an order from an outer side of the second packing material to an inner side of the second packing material, the third wipe is packed in a third packing material configured such that the wipe substrate and the sodium thiosulfate aqueous solution are stored, and the third packing material is a bag-type article in which polyethylene/aluminum/polyethylene layers are stacked in an order from an outer side of the third packing material to an inner side of the third packing material, and wherein an area of each of the first, second and third wipes falls within a range of 525 to 930 $cm^2$ for wiping of an area of about 3500 $cm^2$, which is the smallest space used for preparation of the anticancer agent, and a thickness of each of the first, second and third wipes is in a range of 0.2 to 0.5 mm.

12. The method according to claim 11, wherein an interval of at least 60 seconds is set between the respective steps.

13. A wipe set for used in the method of claim 11, comprising:

the first wipe impregnated with 65 to 170 mg of a sodium hypochlorite aqueous solution per gram of the first wipe;

the second wipe impregnated with 4 to 110 mg of a sodium hydroxide aqueous solution per gram of the second wipe; and the third wipe impregnated with 35 to 92 mg of a sodium thiosulfate aqueous solution per gram of the third wipe, wherein said first wipe further contains 8.5 to 34 mg of sodium hydroxide per gram of the first wipe, and chlorine concentration of sodium hypochlorite in said first wipe is maintained by said sodium hydroxide, wherein each of the first, second and third wipes includes a wipe substrate, and the wipe substrate is a nonwoven fabric made of 100% polypropylene, and wherein the first wipe is packed in the first packing material configured such that the wipe substrate, the sodium hypochlorite aqueous solution and the sodium hydroxide aqueous solution are stored, and the first packing material is the bag-type article in which polyethylene/aluminum/polyethylene layers are stacked in the order from the outer side of the first packing material to the inner side of the first packing material, the second wipe is packed in the second packing material configured such that the wipe substrate and the sodium hydroxide aqueous solution are stored, and the second packing material is the bag-type article in which polyethylene/aluminum/polyethylene layers are stacked in the order from the outer side of the second packing material to the inner side of the second packing material, and the third wipe is packed in the third packing material configured such that the wipe substrate and the sodium thiosulfate aqueous solution are stored, and the third packing material is the bag-type article in which polyethylene/aluminum/polyethylene layers are stacked in the order from the outer side of the third packing material to the inner side of the third packing material.

14. The method according to claim 11, wherein each of the first, second and third packing materials includes two storage portions each being capable of storing a filling, and a barrier sealed part which is peelable by pressing one of the storage portions is formed between the two storage portions.

15. The method according to claim 11, wherein a thickness of each of the first, second and third wipes falls within a range of 0.2 to 0.3 mm.

* * * * *